US010899166B2

(12) United States Patent
Pervan et al.

(10) Patent No.: US 10,899,166 B2
(45) Date of Patent: Jan. 26, 2021

(54) DIGITALLY INJECTED DESIGNS IN POWDER SURFACES

(75) Inventors: Darko Pervan, Viken (SE); Niclas Håkansson, Viken (SE); Jan Jacobsson, Landskrona (SE); Melker Ryberg, Malmö (SE); Göran Ziegler, Viken (SE)

(73) Assignee: VALINGE INNOVATION AB, Viken (SE)

( * ) Notice: Subject to any disclaimer, the term of this patent is extended or adjusted under 35 U.S.C. 154(b) by 751 days.

(21) Appl. No.: 13/084,974

(22) Filed: Apr. 12, 2011

(65) Prior Publication Data

US 2011/0250404 A1 Oct. 13, 2011

Related U.S. Application Data

(60) Provisional application No. 61/323,573, filed on Apr. 13, 2010.

(51) Int. Cl.
*B44C 5/04* (2006.01)
*E04F 15/10* (2006.01)
(Continued)

(52) U.S. Cl.
CPC ..... *B44C 5/0446* (2013.01); *B44C 5/0476* (2013.01); *E04F 13/0866* (2013.01); *E04F 13/0894* (2013.01); *E04F 15/02038* (2013.01); *E04F 15/107* (2013.01); *B05D 3/12* (2013.01); *B05D 5/00* (2013.01); *E04F 2201/0153* (2013.01); *Y10T 428/2462* (2015.01); *Y10T 428/24868* (2015.01); *Y10T 428/24893* (2015.01)

(58) Field of Classification Search
CPC .. B44C 5/0446; B44C 5/0476; E04F 13/0866; E04F 13/0894; E04F 15/02038; E04F 15/107; E04F 2201/0153; Y10T 428/2462; Y10T 428/24868; Y10T 428/24893
USPC ..... 427/265, 264, 180, 197, 201, 202, 203, 427/258, 261, 262
See application file for complete search history.

(56) References Cited

U.S. PATENT DOCUMENTS 2,231,953 A * 2/1941 Ruzicka ..... D21C 3/26 162/71
2,587,064 A * 2/1952 Rapson ..... 162/87
(Continued)

FOREIGN PATENT DOCUMENTS

AU 80284/75 6/1975
CA 2 557 096 A1 7/2005
(Continued)

OTHER PUBLICATIONS

Engstrand, Fiber based panels with a wear resistance surface, Valinge Innovation, Nov. 17, 2008, IP.com No. IPCOM000176590D, IP.com PriorArtDatabase, 76 pages.*
(Continued)

*Primary Examiner* — James M Mellott
(74) *Attorney, Agent, or Firm* — Buchanan Ingersoll & Rooney P.C.

(57) ABSTRACT

Building panels and a method to produce such panels including a solid decorative surface having a decorative wear layer including fibres, binders, colour substance, wear resistant particles and a digital ink print.

33 Claims, 17 Drawing Sheets

(51) Int. Cl.

| | |
|---|---|
| ***E04F 13/08*** | (2006.01) |
| ***E04F 15/02*** | (2006.01) |
| *B05D 5/00* | (2006.01) |
| *B05D 3/12* | (2006.01) |

(56) References Cited

U.S. PATENT DOCUMENTS 2,831,793 A 4/1958 Elmendorf
2,962,081 A 11/1960 Dobry et al.
3,032,820 A 5/1962 Johnson
3,083,116 A 3/1963 Berndt
3,135,643 A 6/1964 Michl
3,286,006 A 11/1966 Annand
3,308,013 A 3/1967 Bryant
3,325,302 A 6/1967 Hosfeld
3,342,621 A 9/1967 Point et al.
3,345,234 A 10/1967 Jecker et al.
3,373,070 A 3/1968 Fuerst
3,426,730 A 2/1969 Lawson et al.
3,440,076 A 4/1969 Vaurio
3,446,184 A 5/1969 Johnson
3,463,653 A 8/1969 Letter
3,486,484 A 12/1969 Bullough
3,533,725 A 10/1970 Bridgeford
3,540,978 A 11/1970 Ames
3,545,997 A 12/1970 Hochberg
3,565,665 A 2/1971 Stranch et al.
3,673,020 A 6/1972 De Jaeger
3,793,125 A 2/1974 Kunz
3,846,219 A 11/1974 Kunz
3,880,687 A 4/1975 Elmendorf et al.
3,897,185 A 7/1975 Beyer
3,897,588 A 7/1975 Nohtomi
3,914,359 A 10/1975 Bevan
3,961,108 A 6/1976 Rosner et al.
4,052,739 A 10/1977 Wada et al.
4,093,766 A 6/1978 Scher et al.
4,131,705 A 12/1978 Kubinsky
4,227,200 A 10/1980 Mansukhani
4,233,387 A 11/1980 Mammino et al.
4,255,480 A 3/1981 Scher
4,312,268 A 1/1982 King et al.
4,313,857 A 2/1982 Blount
4,337,290 A 6/1982 Kelly et al.
4,400,705 A * 8/1983 Horike ..... B41J 2/072 310/315
4,420,525 A 12/1983 Parks
4,430,375 A 2/1984 Scher et al.
4,474,920 A 10/1984 Kyminas et al.
4,890,656 A 1/1990 Ohsumi et al.
4,943,816 A 7/1990 Sporer
5,034,272 A 7/1991 Lindgren et al.
5,134,026 A 7/1992 Melcher
5,206,066 A 4/1993 Horacek
5,246,765 A 9/1993 Lussi et al.
5,258,216 A 11/1993 Von Bonin et al.
5,266,384 A 11/1993 O'Dell
5,314,554 A 5/1994 Owens
5,422,170 A 6/1995 Iwata et al.
5,466,511 A 11/1995 O'Dell et al.
5,486,231 A 1/1996 Dulaney
5,543,193 A 8/1996 Tesch
5,569,424 A 10/1996 Amour
5,594,484 A 1/1997 Furukawa
5,601,930 A 2/1997 Mehta et al.
5,604,025 A 2/1997 Tesch
5,609,966 A 3/1997 Perrin et al.
5,627,578 A 5/1997 Weintraub
5,718,753 A 2/1998 Suzuki et al.
5,766,522 A 6/1998 Daly et al.
5,778,789 A 7/1998 Krishnan et al.
5,827,788 A 10/1998 Miyakoshi
5,855,832 A 1/1999 Clausi
5,865,003 A 2/1999 Klett
5,891,564 A 4/1999 Shultz et al.
5,925,296 A 7/1999 Leese
5,942,072 A 8/1999 McKinnon
6,036,137 A 3/2000 Myren
6,094,882 A 8/2000 Pervan
6,103,377 A 8/2000 Clausi
6,238,750 B1 5/2001 Correll et al.
6,387,457 B1 5/2002 Jiang et al.
6,394,595 B1 5/2002 Jiang et al.
6,468,645 B1 10/2002 Clausi
6,521,326 B1 2/2003 Fischer et al.
6,537,610 B1 * 3/2003 Springer et al. ..... 427/185
6,585,369 B1 7/2003 Sievert et al.
6,620,349 B1 9/2003 Lopez
6,666,951 B1 12/2003 Kostiw
6,769,217 B2 8/2004 Nelson
6,773,799 B1 8/2004 Persson et al.
6,803,110 B2 10/2004 Drees et al.
6,926,954 B2 8/2005 Schueren et al.
6,991,830 B1 * 1/2006 Hansson et al. ..... 427/504
7,022,756 B2 4/2006 Singer
7,485,693 B2 * 2/2009 Matsuda et al. ..... 528/36
7,811,489 B2 10/2010 Pervan
8,337,947 B2 12/2012 Camorani
8,349,234 B2 1/2013 Ziegler et al.
8,349,235 B2 1/2013 Pervan et al.
8,371,456 B2 2/2013 Scadden
8,419,877 B2 4/2013 Pervan et al.
8,431,054 B2 4/2013 Pervan et al.
8,480,841 B2 7/2013 Pervan et al.
8,481,111 B2 7/2013 Ziegler et al.
8,617,439 B2 12/2013 Pervan et al.
8,663,785 B2 3/2014 Ziegler et al.
8,728,564 B2 5/2014 Ziegler et al.
8,784,587 B2 7/2014 Lindgren et al.
8,920,874 B2 12/2014 Ziegler et al.
8,920,876 B2 12/2014 Vetter et al.
8,973,270 B2 3/2015 Siebert et al.
8,993,049 B2 3/2015 Pervan
9,079,212 B2 7/2015 Pervan et al.
9,085,905 B2 7/2015 Persson et al.
9,181,698 B2 11/2015 Pervan et al.
9,255,405 B2 2/2016 Pervan et al.
9,279,058 B2 3/2016 Pervan et al.
9,296,191 B2 3/2016 Pervan et al.
9,321,925 B2 4/2016 Pervan et al.
9,352,499 B2 5/2016 Ziegler et al.
9,371,456 B2 6/2016 Pervan et al.
9,403,286 B2 8/2016 Vetter et al.
9,410,319 B2 8/2016 Ziegler et al.
9,446,602 B2 9/2016 Pervan
9,528,011 B2 12/2016 Pervan et al.
9,556,622 B2 1/2017 Pervan et al.
9,630,404 B2 4/2017 Pervan et al.
9,670,371 B2 6/2017 Pervan et al.
9,738,095 B2 8/2017 Pervan et al.
9,783,996 B2 10/2017 Pervan et al.
9,873,803 B2 1/2018 Pervan et al.
10,016,988 B2 7/2018 Pervan et al.
10,017,950 B2 7/2018 Pervan
10,029,484 B2 7/2018 Pervan et al.
10,035,358 B2 7/2018 Pervan et al.
10,041,212 B2 8/2018 Pervan
10,100,535 B2 10/2018 Pervan et al.
10,189,281 B2 1/2019 Pervan et al.
10,214,913 B2 2/2019 Persson et al.
10,286,633 B2 5/2019 Lundblad et al.
10,315,219 B2 6/2019 Jacobsson
10,344,379 B2 7/2019 Pervan et al.
10,364,578 B2 7/2019 Pervan
10,369,814 B2 8/2019 Pervan et al.
10,384,471 B2 8/2019 Pervan et al.
10,392,812 B2 8/2019 Pervan
10,414,173 B2 9/2019 Pervan
10,442,152 B2 10/2019 Schulte
10,442,164 B2 10/2019 Schulte
10,493,729 B2 12/2019 Pervan et al.
10,513,094 B2 12/2019 Persson et al.
10,556,447 B2 2/2020 Pervan et al.
2001/0006704 A1 * 7/2001 Chen et al. ..... 427/202

(56) References Cited

U.S. PATENT DOCUMENTS

2001/0009309 A1 7/2001 Taguchi et al.
2001/0022607 A1 9/2001 Takahashi et al.
2002/0054994 A1 5/2002 Dupre et al.
2002/0061389 A1 5/2002 Brooker et al.
2002/0100231 A1 8/2002 Miller
2002/0155297 A1 10/2002 Shuren et al.
2003/0056873 A1 3/2003 Nakos et al.
2003/0059639 A1 3/2003 Worsley
2003/0102094 A1 6/2003 Tirri et al.
2003/0129361 A1 7/2003 Plug
2003/0208980 A1 11/2003 Miller et al.
2004/0086678 A1 5/2004 Chen et al.
2004/0101619 A1 5/2004 Camorani
2004/0123542 A1 7/2004 Grafenauer
2004/0138336 A1* 7/2004 Bredt ..... B28B 1/00 523/160
2004/0169710 A1* 9/2004 Ide ..... B41J 2/2114 347/101
2004/0177788 A1 9/2004 Rick et al.
2004/0191547 A1* 9/2004 Oldorff ..... 428/479.3
2004/0202857 A1 10/2004 Singer
2004/0206036 A1 10/2004 Pervan
2004/0237436 A1 12/2004 Zuber et al.
2004/0247831 A1 12/2004 Nakagawa
2004/0250911 A1 12/2004 Vogel
2005/0003099 A1 1/2005 Quist
2005/0064338 A1* 3/2005 Leahy ..... G03F 3/10 430/300
2005/0079780 A1 4/2005 Rowe et al.
2005/0093194 A1* 5/2005 Oriakhi ..... B28B 1/00 264/113
2005/0193677 A1 9/2005 Vogel
2005/0249923 A1 11/2005 Reichwein et al.
2005/0249929 A1 11/2005 Reichwein et al.
2005/0252130 A1 11/2005 Martensson
2006/0005498 A1 1/2006 Sabater et al.
2006/0008630 A1 1/2006 Thiers et al.
2006/0024465 A1 2/2006 Briere
2006/0032175 A1 2/2006 Chen et al.
2006/0070321 A1 4/2006 Au
2006/0145384 A1 7/2006 Singer
2006/0156672 A1 7/2006 Laurent et al.
2006/0182938 A1 8/2006 Oldorff
2006/0183853 A1 8/2006 Sczepan
2007/0055012 A1 3/2007 Caldwell
2007/0066176 A1 3/2007 Wenstrup et al.
2007/0166516 A1 7/2007 Kim et al.
2007/0184244 A1 8/2007 Doehring
2007/0207296 A1 9/2007 Eisermann
2007/0218260 A1 9/2007 Miclo et al.
2007/0224438 A1 9/2007 Van Benthem et al.
2007/0243359 A1 10/2007 Petersen
2007/0256804 A1 11/2007 Garcis Espino et al.
2008/0000417 A1 1/2008 Pervan et al.
2008/0032120 A1 2/2008 Braun
2008/0048388 A1 2/2008 Gauss et al.
2008/0090032 A1 4/2008 Perrin et al.
2008/0176039 A1 7/2008 Chen et al.
2008/0241472 A1 10/2008 Shiao et al.
2008/0261003 A1 10/2008 Lewis et al.
2008/0263985 A1 10/2008 Hasch et al.
2009/0010682 A1 1/2009 Camorani
2009/0056257 A1 3/2009 Mollinger et al.
2009/0116966 A1 5/2009 Althoff et al.
2009/0124704 A1 5/2009 Jenkins
2009/0135356 A1 5/2009 Ando
2009/0139170 A1 6/2009 Thiers
2009/0145066 A1 6/2009 Pervan
2009/0151866 A1 6/2009 Endert
2009/0155612 A1 6/2009 Pervan et al.
2009/0208646 A1 8/2009 Kreuder et al.
2009/0294037 A1 12/2009 Oldorff
2009/0311433 A1 12/2009 Wittmann
2010/0092731 A1 4/2010 Pervan et al.
2010/0196678 A1 8/2010 Vermeulen
2010/0223881 A1 9/2010 Kalwa
2010/0239820 A1 9/2010 Buhlmann
2010/0291397 A1 11/2010 Pervan et al.
2010/0300030 A1 12/2010 Pervan et al.
2010/0307675 A1 12/2010 Buhlmann
2010/0307677 A1 12/2010 Buhlmann
2010/0319282 A1 12/2010 Ruland
2010/0323187 A1 12/2010 Kalwa
2010/0330376 A1 12/2010 Trksak
2011/0171412 A1 7/2011 Döhring
2011/0175251 A1 7/2011 Ziegler
2011/0177319 A1 7/2011 Ziegler et al.
2011/0177354 A1 7/2011 Ziegler et al.
2011/0189448 A1 8/2011 Lindgren et al.
2011/0189471 A1 8/2011 Ziegler
2011/0247748 A1 10/2011 Pervan et al.
2011/0250404 A1 10/2011 Pervan et al.
2011/0262720 A1 10/2011 Riebel et al.
2011/0283642 A1 11/2011 Meirlaen et al.
2011/0283650 A1 11/2011 Pervan et al.
2011/0293823 A1 12/2011 Bruderer et al.
2011/0293906 A1 12/2011 Jacobsson
2012/0263878 A1 10/2012 Ziegler et al.
2012/0263965 A1 10/2012 Persson et al.
2012/0264853 A1 10/2012 Ziegler et al.
2012/0269983 A1 10/2012 Grinberg
2012/0288689 A1 11/2012 Hansson et al.
2012/0308774 A1 12/2012 Persson et al.
2013/0043211 A1 2/2013 Vermuelen
2013/0065072 A1 3/2013 Pervan
2013/0092314 A1 4/2013 Ziegler et al.
2013/0095315 A1 4/2013 Pervan et al.
2013/0108873 A1 5/2013 Shiao et al.
2013/0111845 A1 5/2013 Pervan et al.
2013/0189534 A1 7/2013 Pervan et al.
2013/0269863 A1 10/2013 Pervan et al.
2013/0273244 A1 10/2013 Vetter et al.
2013/0273245 A1 10/2013 Ziegler et al.
2014/0017452 A1 1/2014 Pervan et al.
2014/0023832 A1 1/2014 Pervan et al.
2014/0028772 A1 1/2014 Pervan
2014/0044872 A1 2/2014 Pervan
2014/0075874 A1 3/2014 Pervan et al.
2014/0171554 A1 6/2014 Ziegler et al.
2014/0178630 A1 6/2014 Pervan et al.
2014/0186610 A1 7/2014 Pervan
2014/0196618 A1 7/2014 Pervan et al.
2014/0198168 A1 7/2014 Pervan et al.
2014/0198170 A1 7/2014 Pervan et al.
2014/0199495 A1 7/2014 Pervan et al.
2014/0199513 A1 7/2014 Pervan et al.
2014/0199531 A1 7/2014 Pervan et al.
2014/0199558 A1 7/2014 Pervan et al.
2014/0220318 A1 8/2014 Pervan
2014/0234531 A1 8/2014 Ziegler et al.
2014/0255670 A1 9/2014 Kalwa
2015/0017461 A1 1/2015 Lindgren et al.
2015/0079280 A1 3/2015 Vetter et al.
2015/0093502 A1 4/2015 Ziegler et al.
2015/0111055 A1 4/2015 Persson et al.
2015/0159382 A1 6/2015 Pervan
2015/0197942 A1 7/2015 Pervan et al.
2015/0197943 A1 7/2015 Ziegler et al.
2015/0274997 A1 10/2015 Pervan et al.
2015/0275526 A1 10/2015 Persson et al.
2015/0298433 A1 10/2015 Kalwa
2016/0031189 A1 2/2016 Pervan et al.
2016/0114495 A1 4/2016 Pervan et al.
2016/0144612 A1 5/2016 Pervan et al.
2016/0186318 A1 6/2016 Pervan et al.
2016/0208116 A1 7/2016 Pervan et al.
2016/0230400 A9 8/2016 Pervan et al.
2016/0250853 A1 9/2016 Pervan et al.
2016/0325559 A1 11/2016 Pervan et al.
2016/0368180 A1 12/2016 Ziegler et al.
2016/0368280 A1 12/2016 Pervan
2016/0369507 A1 12/2016 Pervan
2016/0375674 A1 12/2016 Schulte
2017/0066255 A1 3/2017 Pervan et al.

(56) References Cited

U.S. PATENT DOCUMENTS

| | | | |
|---|---|---|---|
| 2017/0120564 | A1 | 5/2017 | Schulte |
| 2017/0165936 | A1 | 6/2017 | Schulte |
| 2017/0190156 | A1 | 7/2017 | Ziegler et al. |
| 2017/0204281 | A1 | 7/2017 | Pervan et al. |
| 2017/0232761 | A1 | 8/2017 | Pervan et al. |
| 2017/0305119 | A1 | 10/2017 | Bergelin et al. |
| 2017/0348984 | A1 | 12/2017 | Pervan et al. |
| 2018/0002934 | A1 | 1/2018 | Pervan et al. |
| 2018/0111390 | A1 | 4/2018 | Pervan et al. |
| 2018/0127605 | A1 | 5/2018 | Pervan et al. |
| 2018/0178553 | A1 | 6/2018 | Pervan |
| 2018/0291638 | A1 | 10/2018 | Pervan |
| 2018/0298216 | A1 | 10/2018 | Pervan et al. |
| 2018/0320321 | A1 | 11/2018 | Pervan |
| 2018/0370278 | A1 | 12/2018 | Persson et al. |
| 2019/0010711 | A1 | 1/2019 | Pervan et al. |
| 2019/0119513 | A1 | 4/2019 | Pervan et al. |
| 2019/0202178 | A1 | 7/2019 | Ziegler |
| 2019/0210329 | A1 | 7/2019 | Ziegler et al. |
| 2019/0210330 | A1 | 7/2019 | Ziegler et al. |
| 2019/0277039 | A1 | 9/2019 | Persson et al. |
| 2019/0284819 | A1 | 9/2019 | Pervan et al. |
| 2019/0284821 | A1 | 9/2019 | Pervan |
| 2019/0292796 | A1 | 9/2019 | Pervan et al. |
| 2019/0338534 | A1 | 11/2019 | Pervan |
| 2019/0345348 | A1 | 11/2019 | Pervan et al. |
| 2019/0351685 | A1 | 11/2019 | Pervan |
| 2020/0055287 | A1 | 2/2020 | Lundblad et al. |
| 2020/0078825 | A1 | 3/2020 | Jacobsson |
| 2020/0079059 | A1 | 3/2020 | Schulte |
| 2020/0079114 | A1 | 3/2020 | Pervan et al. |
| 2020/0215799 | A1 | 7/2020 | Hedlund et al. |
| 2020/0223197 | A1 | 7/2020 | Hedlund et al. |

FOREIGN PATENT DOCUMENTS

| | | | |
|---|---|---|---|
| CH | 298894 | A | 5/1954 |
| CH | 298 894 | | 8/1954 |
| DE | 1 815 312 | A1 | 7/1969 |
| DE | 7148789 | | 4/1972 |
| DE | 7148789 | U | 4/1972 |
| DE | 29 39 828 | A1 | 4/1981 |
| DE | 33 34 921 | A1 | 4/1985 |
| DE | 42 36 266 | A1 | 5/1993 |
| DE | 202 14 532 | U1 | 2/2004 |
| DE | 103 31 657 | A1 | 2/2005 |
| DE | 20 2004 003 061 | U1 | 7/2005 |
| DE | 10 2004 050 278 | A1 | 4/2006 |
| DE | 20 2006 007 797 | U1 | 8/2006 |
| DE | 10 2005 046 264 | A1 | 4/2007 |
| DE | 10 2006 024 593 | A1 | 12/2007 |
| DE | 10 2007 028 822 | A1 | 12/2008 |
| DE | 10 2007 062 600 | A1 | 6/2009 |
| EP | 0 129 430 | A2 | 12/1984 |
| EP | 0 129 430 | B1 | 1/1990 |
| EP | 0 355 829 | A2 | 2/1990 |
| EP | 0 403 264 | A2 | 12/1990 |
| EP | 2 248 246 | A | 4/1992 |
| EP | 0 611 408 | A1 | 12/1993 |
| EP | 0 592 013 | A2 | 4/1994 |
| EP | 0 656 443 | A1 | 6/1995 |
| EP | 0 657 309 | A1 | 6/1995 |
| EP | 0 611 408 | B1 | 9/1996 |
| EP | 0 732 449 | A1 | 9/1996 |
| EP | 0 744 477 | A2 | 11/1996 |
| EP | 0 769 535 | A2 | 4/1997 |
| EP | 0 769 535 | A3 | 9/1997 |
| EP | 0 914 914 | A2 | 5/1999 |
| EP | 0 732 449 | B1 | 8/1999 |
| EP | 0 744 477 | B1 | 1/2000 |
| EP | 1 020 765 | A1 | 7/2000 |
| EP | 1 035 255 | A1 | 9/2000 |
| EP | 1 125 971 | A1 | 8/2001 |
| EP | 1 136 251 | A2 | 9/2001 |
| EP | 1 193 288 | A1 | 4/2002 |
| EP | 1 209 199 | A1 | 5/2002 |
| EP | 1 242 702 | A1 | 9/2002 |
| EP | 1 249 322 | A1 | 10/2002 |
| EP | 1 454 763 | A2 | 9/2004 |
| EP | 1 242 702 | B1 | 11/2004 |
| EP | 1 498 241 | A2 | 1/2005 |
| EP | 1 507 664 | A1 | 2/2005 |
| EP | 1 507 664 | B1 | 2/2005 |
| EP | 1 584 378 | A1 | 10/2005 |
| EP | 1 681 103 | A2 | 7/2006 |
| EP | 1 690 603 | A1 | 8/2006 |
| EP | 1 847 385 | A1 | 10/2007 |
| EP | 1 961 556 | A1 | 8/2008 |
| EP | 1 985 464 | A1 | 10/2008 |
| EP | 1 997 623 | A1 | 12/2008 |
| EP | 2 025 484 | A1 | 2/2009 |
| EP | 1 454 763 | B1 | 8/2009 |
| EP | 2 105 320 | A1 | 9/2009 |
| EP | 2 106 903 | A1 | 10/2009 |
| EP | 2 108 524 | A1 | 10/2009 |
| EP | 2 202 056 | A1 | 6/2010 |
| EP | 2 213 476 | A1 | 8/2010 |
| EP | 2 226 201 | A1 | 9/2010 |
| EP | 2 246 500 | A2 | 11/2010 |
| EP | 2 264 259 | A2 | 12/2010 |
| EP | 2 272 667 | A1 | 1/2011 |
| EP | 2 272 668 | A1 | 1/2011 |
| EP | 2 305 462 | A1 | 4/2011 |
| EP | 1 847 385 | B1 | 9/2011 |
| FR | 2 873 953 | A1 | 2/2006 |
| GB | 984 170 | A | 2/1965 |
| GB | 1090450 | | 11/1967 |
| GB | 1 344 197 | A | 1/1974 |
| GB | 2 065 556 | A | 7/1981 |
| GB | 2 128 898 | A | 5/1984 |
| GB | 2 452 545 | A | 3/2009 |
| JP | S51-128409 | A | 11/1976 |
| JP | 2-229002 | A | 9/1990 |
| JP | H05-320541 | A | 12/1993 |
| JP | H06-183128 | A | 7/1994 |
| JP | H06-287467 | A | 10/1994 |
| JP | H10-095165 | A | 4/1998 |
| JP | 11-291203 | A | 10/1999 |
| JP | 2000-158796 | A | 6/2000 |
| JP | 2001-287208 | A | 10/2001 |
| JP | 2003-311717 | A | 11/2003 |
| JP | 2003-311718 | A | 11/2003 |
| JP | 2005-034815 | A | 2/2005 |
| JP | 2005-074682 | A | 3/2005 |
| JP | 2005-097339 | A | 4/2005 |
| JP | 2005-170016 | A | 6/2005 |
| JP | 2005-219215 | A | 8/2005 |
| JP | 3705482 | B2 | 10/2005 |
| JP | 2005-307582 | A | 11/2005 |
| JP | 2006-036559 | A | 2/2006 |
| JP | 2006-167651 | A | 6/2006 |
| JP | 2007-216692 | A | 8/2007 |
| JP | 2007-268843 | A | 10/2007 |
| JP | 2008-188826 | A | 8/2008 |
| JP | 2008-265229 | A | 11/2008 |
| JP | 2010-209325 | A | 9/2010 |
| NZ | 225556 | A1 | 2/1992 |
| SE | 469 326 | B | 6/1993 |
| WO | WO 89/03753 | A1 | 5/1989 |
| WO | WO 92/06832 | A1 | 4/1992 |
| WO | WO 93/24295 | A1 | 12/1993 |
| WO | WO 93/24296 | A1 | 12/1993 |
| WO | WO 94/00280 | A1 | 1/1994 |
| WO | WO 95/06568 | A1 | 3/1995 |
| WO | WO 00/22225 | A1 | 4/2000 |
| WO | WO 00/44576 | A1 | 8/2000 |
| WO | WO 01/00409 | A1 | 1/2001 |
| WO | WO 01/48333 | A1 | 7/2001 |
| WO | WO 01/64408 | A1 | 9/2001 |
| WO | WO 01/68367 | A1 | 9/2001 |
| WO | WO 01/72489 | A2 | 10/2001 |
| WO | WO 01/92037 | A2 | 12/2001 |
| WO | WO 02/42167 | A2 | 5/2002 |
| WO | WO 02/42373 | A1 | 5/2002 |

(56) References Cited

FOREIGN PATENT DOCUMENTS

| | | | | |
|---|---|---|---|---|
| WO | WO 02/058944 | A1 | 8/2002 | |
| WO | WO 03/078761 | A1 | 9/2003 | |
| WO | WO 03/095202 | A1 | 11/2003 | |
| WO | WO 2004/042168 | A1 | 5/2004 | |
| WO | WO 2004/050359 | A1 | 6/2004 | |
| WO | WO 2004/067874 | A2 | 8/2004 | |
| WO | WO 2005/010296 | A1 | 2/2005 | |
| WO | WO 2005/054600 | A1 | 6/2005 | |
| WO | WO 2005/066431 | A2 | 7/2005 | |
| WO | WO 2005/080096 | A2 | 9/2005 | |
| WO | WO 2005/097874 | A2 | 10/2005 | |
| WO | WO 2005/116337 | A1 | 12/2005 | |
| WO | WO 2005/116361 | A1 | 12/2005 | |
| WO | WO 2005/120847 | A1 | 12/2005 | |
| WO | WO 2006/002733 | A1 | 1/2006 | |
| WO | WO 2006/007413 | A1 | 1/2006 | |
| WO | WO 2006/013469 | A1 | 2/2006 | |
| WO | WO 2006/015313 | A2 | 2/2006 | |
| WO | WO 2006/042651 | A1 | 4/2006 | |
| WO | WO 2006/043893 | A1 | 4/2006 | |
| WO | WO 2006/066776 | A2 | 6/2006 | |
| WO | WO 2006/125036 | A2 | 11/2006 | |
| WO | WO 2006/126930 | A1 | 11/2006 | |
| WO | WO 2007/015669 | A2 | 2/2007 | |
| WO | WO 2007/015669 | A3 | 2/2007 | |
| WO | WO 2007/042258 | A1 | 4/2007 | |
| WO | WO 2007/059294 | A2 | 5/2007 | |
| WO | WO 2007/060298 | A1 | 5/2007 | |
| WO | WO 2007/096746 | A2 | 8/2007 | |
| WO | WO 2008/004960 | A2 | 1/2008 | |
| WO | WO 2008/004960 | A3 | 1/2008 | |
| WO | WO 2008/004960 | A8 | 1/2008 | |
| WO | WO 2008/042088 | A1 | 4/2008 | |
| WO | WO 2008/121749 | A1 | 10/2008 | |
| WO | WO 2008/148771 | A1 | 12/2008 | |
| WO | WO 2009/030935 | A2 | 3/2009 | |
| WO | WO 2009/065768 | A1 | 5/2009 | |
| WO | WO 2009/065769 | A2 | 5/2009 | |
| WO | WO 2009/065769 | A3 | 5/2009 | |
| WO | WO 2009065769 | A2 * | 5/2009 | ..... B32B 21/02 |
| WO | WO 2009/080772 | A1 | 7/2009 | |
| WO | WO 2009/080813 | A1 | 7/2009 | |
| WO | WO 2009/116926 | A1 | 9/2009 | |
| WO | WO 2009/124704 | A1 | 10/2009 | |
| WO | WO 2009/153680 | A2 | 12/2009 | |
| WO | WO 2010/084466 | A2 | 7/2010 | |
| WO | WO 2010/087752 | A1 | 8/2010 | |
| WO | WO 2010/094500 | A1 | 8/2010 | |
| WO | WO 2011/064075 | A2 | 6/2011 | |
| WO | WO 2011/077200 | A1 | 6/2011 | |
| WO | WO 2011/087422 | A1 | 7/2011 | |
| WO | WO 2011/087423 | A1 | 7/2011 | |
| WO | WO 2011/107610 | A1 | 9/2011 | |
| WO | WO 2011/129757 | A1 | 10/2011 | |
| WO | WO 2011/141851 | A2 | 11/2011 | |
| WO | WO 2012/004699 | A2 | 1/2012 | |
| WO | WO 2012/037950 | A1 | 3/2012 | |
| WO | WO 2012/141647 | A1 | 10/2012 | |

OTHER PUBLICATIONS

Engstrand, Ola (Contact)/Valinge Innovation, Technical Disclosure entitled "Fibre Based Panels With a Wear Resistance Surface," Nov. 17, 2008, IP.com No. IPCOM000176590D, IP.com PriorArtDatabase, 76 pages.

Engstrand, Ola (Contact)/Valinge Innovation, Technical Disclosure entitled "WFF Embossing," May 15, 2009, IP.com No. IPCOM000183105D, IP.com PriorArtDatabase, 36 pages.

U.S. Appl. No. 13/444,604, Ziegler et al.

U.S. Appl. No. 13/444,653, Håkansson et al.

U.S. Appl. No. 13/445,379, Ziegler et al.

U.S. Appl. No. 13/469,799, Persson et al.

U.S. Appl. No. 61/612,672, Vetter, et al.

Ziegler, Göran, et al., U.S. Appl. No. 13/444,604, entitled "A Powder Mix and Method for Producing a Building Panel," filed Apr. 11, 2012.

Persson, Hans, et al., U.S. Appl. No. 13/444,653, entitled "Powder Based Balancing Layer," filed Apr. 11, 2012.

Ziegler, Göran, et al, U.S. Appl. No. 13/445,379, entitled "Method of Manufacturing a Layer," filed Apr. 12, 2012.

Persson, Hans, et al., U.S. Appl. No. 13/469,799, entitled "Method of Producing a Powder Layer or a Granular Layer," filed May 11, 2012.

Vetter, Georg, et al., U.S. Appl. No. 61/612,672, entitled "Method for Producing a Building Panel," filed Mar. 19, 2012.

U.S. Appl. No. 13/693,979, Pervan, et al.

U.S. Appl. No. 13/705,310, Ziegler, et al.

Pervan, Darko, et al., U.S. Appl. No. 13/693,979, entitled "Recycling of Laminate Floorings," filed Dec. 4, 2012.

Ziegler, Göran, et al., U.S. Appl. No. 13/705,310, entitled "Fibre Based Panels with a Decorative Wear Resistance Surface," filed Dec. 5, 2012.

U.S. Appl. No. 13/793,971, Pervan, et al.

U.S. Appl. No. 13/804,355, Vetter, et al.

Pervan, Darko, et al., U.S. Appl. No. 13/793,971, entitled "Wood Fibre Based Panels with a Thin Surface Layer," filed Mar. 11, 2013.

Vetter, Georg, et al., U.S. Appl. No. 13/804,355, entitled "Method for Producing a Building Panel," filed Mar. 14, 2013.

U.S. Appl. No. 14/321,288, Lindgren, et al.

Lindgren, Kent, et al., U.S. Appl. No. 14/321,288, entitled "A Method of Manufacturing a Building Panel and a Building Panel," filed Jul. 1, 2014.

U.S. Appl. No. 14/089,928, Pervan, et al.

U.S. Appl. No. 14/151,973, Pervan, et al.

Pervan, Darko, et al., U.S. Appl. No. 14/089,928 entitled "Recycling of Laminate Floors," filed Nov. 26, 2013.

Pervan, Darko, et al., U.S. Appl. No. 14/151,973 entitled "A Method of Producing a Building Panel and a Building Panel", filed Jan. 10, 2014.

U.S. Appl. No. 14/237,617, Pervan.

U.S. Appl. No. 14/184,299, Ziegler, et al.

U.S. Appl. No. 14/192,169, Pervan, et al.

U.S. Appl. No. 14/247,839, Ziegler, et al.

Pervan, Darko, U.S. Appl. No. 14/237,617, entitled "Panel Coating," filed Feb. 7, 2014.

Ziegler, Göran, et al., U.S. Appl. No. 14/184,299, entitled "Heat and Pressure Generated Design", filed Feb. 19, 2014.

Pervan, Darko, et al., U.S. Appl. No. 14/192,169, entitled "Fibre Based Panels with a Wear Resistance Surface", filed Feb. 27, 2014.

Ziegler, Göran, et al., U.S. Appl. No. 14/247,839, entitled a Powder Mix and a Method for Producing a Building Panel, filed Apr. 8, 2014.

U.S. Appl. No. 13/873,773, Ryberg, et al.

U.S. Appl. No. 13/938,589, Pervan.

U.S. Appl. No. 13/940,891, Pervan, et al.

U.S. Appl. No. 13/940,572, Pervan.

U.S. Appl. No. 61/730,699, Håkansson, et al.

U.S. Appl. No. 61/751,418, Pervan, et al.

U.S. Appl. No. 61/751,393, Pervan, et al.

Ryberg, Melker, et al., U.S. Appl. No. 13/873,773, entitled "Method for Forming a Decorative Design on an Element of a Wood-Based Material," filed Apr. 30, 2013.

Pervan, Darko, U.S. Appl. No. 13/938,589, entitled "Digital Coating and Printing," filed Jul. 10, 2013.

Pervan, Darko, et al., U.S. Appl. No. 13/940,891, entitled "Digital Embossed in Register Surface," filed Jul. 12, 2013.

Pervan, Darko, U.S. Appl. No. 13/940,572, entitled "Digital Binder Printing," filed Jul. 12, 2013.

Håkansson, Niclas, et al. , U.S. Appl. No. 61/730,699, entitled "Method of Producing a Floor Panel," filed Nov. 28, 2012.

Pervan, Darko, et al., U.S. Appl. No. 61/751,418, entitled "Digital Printing and Embossing," filed Jan. 11, 2013.

Pervan, Darko, et al., U.S. Appl. No. 61/751,393, entitled "Method of Producing a Building Panel and a Building Panel," filed Jan. 11, 2013.

U.S. Appl. No. 13/912,564, Ziegler, et al.

(56) References Cited

OTHER PUBLICATIONS

U.S. Appl. No. 13/912,587, Pervan, et al.
Ziegler, Göran, et al., U.S. Appl. No. 13/912,564, entitled "Bright Coloured Surface Layer," filed Jun. 7, 2013.
Pervan, Darko, et al., U.S. Appl. No. 13/912,587, entitled "Powder Overlay," filed Jun. 7, 2013.
U.S. Appl. No. 14/789,339, Kalwa.
Kalwa, Norbert, U.S. Appl. No. 14/789,339 entitled "Panel, Use of a Panel, Method for Manufacturing a Panel and a Prepreg," filed Jul. 1, 2015.
U.S. Appl. No. 14/980,638, Pervan et al.
U.S. Appl. No. 15/061,303, Pervan et al.
Pervan, Darko, et al., U.S. Appl. No. 14/980,638 entitled "Wood Fibre Based Panels with a Thin Surface Layer," filed Dec. 28, 2015.
Pervan, Darko, et al., U.S. Appl. No. 15/061,303 entitled "Powder Overlay," filed Mar. 4, 2016.
U.S. Appl. No. 15/162,868, Pervan et al.
U.S. Appl. No. 15/204,474, Vetter et al.
Ziegler, Göran, et al., U.S. Appl. No. 15/162,868 entitled "Method of Manufacturing a Layer," filed May 24, 2016.
Vetter, Georg, et al., U.S. Appl. No. 15/204,474 entitled "Method for Producing a Building Panel," filed Jul. 7, 2016.
U.S. Appl. No. 14/516,957, Persson, et al.
U.S. Appl. No. 14/553,196, Vetter, et al.
U.S. Appl. No. 14/563,167, Ziegler, et al.
Persson, Hans, et al., U.S. Appl. No. 14/516,957, entitled "Method of Manufacturing a Building Panel," filed Oct. 17, 2014.
Vetter, Georg, et al., U.S. Appl. No. 14/553,196, entitled "Method for Producing a Building Panel," filed Nov. 25, 2014.
Ziegler Göran, et al., U.S. Appl. No. 14/563,167, entitled "Bright Coloured Surface Layer," filed Dec. 8, 2014.
BTLSR Toledo, Inc. website. http://www.btlresins.com/more.html. "Advantages to Using Powdered Resins," May 26, 2007, 2 pages, per the Internet Archive WayBackMachine.
Nimz, H.H., "Wood" Ullmann's Encyclopedia of Industrial Chemistry, published online Jun. 15, 2000, pp. 453-505, vol. 39, Wiley-VCH Verlag GmbH & Co. KgaA, Weinheim, DE.
Le Fur, X., et al., "Recycling melamine-impregnated paper waste as board adhesives," published online Oct. 26, 2004, pp. 419-423, vol. 62, Springer-Verlag, DE.
Odian, George, "Principles of Polymerization," 1991, 3rd Edition, 5 pages incl. pp. 122-123, John Wiley & Sons, Inc., New York, NY, USA.
"Hex Netting—Fencing—Ace Hardware," from http://www.acehardware.com/family/index.jsp?categoryId=1260278 archived on Nov. 1, 2009. accessed through the Internet Archive; WaybackMachine, 3 pages.
U.S. Appl. No. 15/656,358, Darko Pervan and Tony Pervan, filed Jul. 21, 2017.
Extended European Search Report dated Jan. 22, 2015 in EP 11769174.1, European Patent Office, Munich, DE, 5 pages.
Extended European Search Report dated Jan. 23, 2015 in EP 14193901.7, European Patent Office, Munich, DE, 5 pages.
Romano, Frank J., Digital Printing Pocket Primer Series "Mastering On-Demand and Variable Data Printing for Profit," Copyright 2000, 52 pages, Windsor Professional Information, L.L.C., San Diego, CA.
Hudd, "Chapter 1: Inkjet Printing Technologies," *Chemistry of Inkjet Inks*, 2010, pp. 3-18, World Scientific Publishing Co. PTE. Ltd. , Published in Singapore and Hackensack, NJ.
Owens, James C., "A Tutorial on Printing", *Imaging.org-Resources*, 2010, pp. 1-5, Society for Imaging Sciences and Technology, retrieved Jul. 27, 2015 from http://web.archive.org/web/20100706153535/http://www.imaging.org/ist/resources/tutorial.
U.S. Appl. No. 15/704,634, Pervan, et al.
Pervan, Darko, et al. , U.S. Appl. No. 15/704,634 entitled "Fibre Based Panels With a Wear Resistance Surface," filed Sep. 14, 2017.
U.S. Appl. No. 61/349,950, Jacobsson.
U.S. Appl. No. 61/474,485, Ziegler et al.
U.S. Appl. No. 61/976,498, Håkansson et al.
U.S. Appl. No. 12/976,213, Ziegler et al.
U.S. Appl. No. 12/976,329, Ziegler et al.
U.S. Appl. No. 12/976,350, Ziegler et al.
U.S. Appl. No. 12/976,478, Lindgren et al.
U.S. Appl. No. 13/084,955, Pervan et al.
Jacobsson, U.S. Appl. No. 61/349,950, entitled "Production Method," filed May 31, 2010.
Ziegler, Göran,et al., U.S. Appl. No. 61/474,485, entitled "Pre Treated Powder," filed Apr. 12, 2011.
Håkansson, Niclas, et al., U.S. Appl. No. 61/474,498, entitled "Powder Based Balancing Layer," filed Apr. 12, 2011.
Ziegler, Goran et al. U.S. Appl. No. 12/976,213, entitled "Heat and Pressure Generated Design," filed Dec. 22, 2010.
Ziegler, Goran et al. U.S. Appl. No. 12/976,329, entitled "Bright Coloured Surface Layer," filed Dec. 22, 2010.
Ziegler, Goran et al. U.S. Appl. No. 12/976,350, entitled "Fibre Based Panels with a Decorative Wear Resistance Surface," filed Dec. 22, 2010.
Lindgren, Kent et al. U.S. Appl. No. 12/976,478, entitled "Fibre Based Panels with a Decorative Wear Resistance Surface," filed Dec. 22, 2010.
Pervan, Darko, et al., U.S. Appl. No. 13/084,955, entitled "Powder Overlay," filed Apr. 12, 2011.
U.S. Appl. No. 13/118,846, Jan Jacobsson, filed May 31, 2011.
U.S. Appl. No. 61/485,930, Hans Persson, Peter Wingårdh and Niclas Håkansson, filed May 13, 2011.
U.S. Appl. No. 61/557,643, Hans Persson, Peter Wingårdh, Niclas Håkansson and Peter Stjerna, filed Nov. 9, 2011.
U.S. Appl. No. 61/557,734, Niclas Håkansson and Hans Persson, filed Nov. 9, 2011.
U.S. Appl. No. 61/485,930, Persson et al.
U.S. Appl. No. 61/557,643, Persson et al.
U.S. Appl. No. 61/557,734, Håkansson et al.
Persson, Hans, et al., U.S. Appl. No. 61/485,930, entitled "Scattering," filed May 13, 2011.
Persson, Hans, et al., U.S. Appl. No. 61/557,643, entitled "Scattering", filed Nov. 9, 2011.
Håkansson, Niclas, et al., U.S. Appl. No. 61/557,734, entitled "Powder Based Balancing Layer" filed Nov. 9, 2011.
International Search Report issued in PCT/SE2011/050449, dated Sep. 5, 2011, 7 pp., Swedish Patent Office, Stockholm, SE.
Parquet International, "Digital Printing is still an expensive process," Mar. 2008, cover page/pp. 78-79, www.parkettmagazin.com.
Floor Daily, "Shaw Laminates: Green by Design," Aug. 13, 2007, 1 pg, Dalton, GA.
U.S. Appl. No. 17/021,316, Darko Pervan and Tony Pervan, filed Sep. 15, 2020.
**Pervan, Darko, et al., U.S. Appl. No. 17/021,316 entitled "Digital Printing with Transparent Blank Ink," filed in the U.S. Patent and Trademark Office dated Sep. 15, 2020.

* cited by examiner

DIGITALLY INJECTED DESIGNS IN POWDER SURFACES

CROSS REFERENCE TO RELATED APPLICATIONS

The present application claims the benefit of U.S. Provisional Application No. 61/323,573, filed on Apr. 13, 2010. The entire contents of U.S. Provisional Application No. 61/323,573 are hereby incorporated herein by reference.

TECHNICAL FIELD

The disclosure generally relates to the field of fibre-based panels with a decorative wear resistant surface, preferably floor and wall panels. The disclosure relates to building panels with such decorative surfaces and to production methods to produce such panels.

FIELD OF APPLICATION

Embodiments of the present invention are particularly suitable for use in floating floors, which are formed of floor panels comprising a core and a decorative wear resistant solid surface layer comprising fibres, binders and wear resistant particles that have been applied on the core as a powder as described in WO 2009/065769, which is herein incorporated by reference in its entirety. The following description of technique, problems of known systems and objects and features of the invention will therefore, as a non-restrictive example, be aimed above all at this field of application and in particular at floorings which are similar to traditional floating wood fibre based laminate floorings. Embodiments of the invention do not exclude floors that are glued down to a sub floor.

It should be emphasized that embodiments of the invention can be used to produce a surface layer integrated with a core or a separate surface layer, which is for example applied to a core in order to form a panel. The invention can also be used in building panels such as for example wall panels, ceilings, and furniture components and similar.

BACKGROUND

Wood fibre based direct pressed laminated flooring (DPL) usually comprises a core of a 6-12 mm fibre board, a 0.2 mm thick upper decorative surface layer of laminate and a 0.1-0.2 mm thick lower balancing layer of laminate, plastic, paper or like material.

The surface layer of a laminate floor is characterized in that the decorative and wear properties are generally obtained with two separate layers one over the other. The decorative layer is generally a printed paper and the wear layer is a transparent overlay paper, which comprises small aluminium oxide particles.

A high quality laminate flooring uses a printed paper with a print that comprises small dots with a size of about 0.10 mm and which are spaced from each other. A minimum line width is about 0.2 mm and there are about 125-200 dots per inch. The print is applied on the surface of the paper.

The printed decorative paper and the overlay are impregnated with melamine resin and laminated to a wood fibre based core under heat and pressure.

Some laminate floorings have a decorative surface that is printed on the core by direct or digital printing. A HDF board is coated with several base layers and the print is provided on the coated surface. The print is thereafter coated with several protective and transparent wear layers High definition digital printers use a non-impact printing processes. The printer has print heads that "fire" drops of ink from the print heads to the substrate.

DPI is used to define the printing quality of a digital printer. It describes the resolution number of dots per inch in the digital print.

A relatively low resolution is typically in the range of 60 to 90 DPI. This allows a high printing speed and a low ink content. A resolution of 90-150 DPI is generally sufficient to provide prints that can be used in flooring applications. 150-300 DPI is generally sufficient to for example print wood grains structures of the same quality presently used in conventional laminate floorings.

Industrial printers can print patterns with a resolution of 300-600 DPI and even more. The resolution and printing speed is improving continuously.

Recently new "paper free" floor types have been developed with solid surfaces comprising a substantially homogenous mix of fibres, binders and wear resistant particles.

The wear resistant particles are preferably aluminium oxide particles, the binders are preferably thermosetting resins such as amino resins and the fibres are preferably wood based. Other suitable wear resistant materials are for example silica or silicon carbide. In most applications decorative particles such as for example colour pigments are included in the homogenous mix. In general all these materials are preferably applied in dry form as a mixed powder on a HDF core and cured under heat and pressure to a 0.1-1.0 mm solid layer.

Several advantages over known technology and especially over conventional laminate floorings can be obtained:

- The wear resistant surface layer, which is a homogenous mix, can be made much thicker and a wear resistance is achieved, which is considerably higher;
- New and very advanced decorative effects can be obtained with deep embossing and by separate decorative materials, which can be incorporated into the homogenous surface layer and coordinated with the embossing;
- An increased impact resistance can be reached with a homogenous surface layer, which is thicker and has a higher density;
- The homogenous surface layer can comprise particles that have a positive impact on sound and moisture properties;
- Production costs can be reduced since low cost and even recycled materials can be used and several production steps can be eliminated.

Powder technology is very suitable to produce a decorative surface layer, which is a copy of stone and ceramics. It is however more difficult to create designs such as for example wood decors.

Powder based floors can reach a much higher market share if advanced designs similar to for example wood floorings can be made in a cost efficient way and with a high wear resistance as described in this application.

The above description of various known aspects is the applicants' characterization of such, and is not an admission that any of the above description is prior art.

DEFINITION OF SOME TERMS

In the following text, the visible surface of the installed floor panel is called "front side", while the opposite side of the floor panel, facing the sub floor, is called "rear side". By "surface layer" are meant all layers which give the panel its decorative properties and its wear resistance and which are applied to the core closest to the front side covering preferably the entire front side of the floorboard.

By "horizontal plane" is meant a plane, which extends parallel to the outer part of the surface layer. By "horizontally" is meant parallel to the horizontal plane and by "vertically" is meant perpendicularly to the horizontal plane. By "up" is meant towards the front side and by "down" towards the rear side. By a "WFF mix" is meant a mix of materials comprising fibres, binders, wear resistant particles and, optionally, a colour substance, that is preferably applied as powder on a carrier.

By "WFF floor" is meant a floor panel comprising a solid surface, which is obtained by a WFF mix that is preferably applied as dry powder on a core, such as for example HDF, and cured under heat and pressure.

By "pigments for digital print ink" is meant a material that changes the color of reflected or transmitted light as the result of wavelength-selective absorption.

By "dye ink" is meant a colored substance that has an affinity to the substrate to which it is being applied. The dye is generally applied in an aqueous solution which also can contain a binder, and may require a mordant to improve the fastness of the dye on the fiber. In contrast to pigments that are small insoluble particles, a dye is completely soluble like sugar in water.

By "aqueous or water based ink" is meant an ink where water is used as liquid substance in the ink. The water based liquid carries the pigments. A binder is present in the system as well to bind the pigments to the substrate.

By "solvent based ink" is meant an ink that generally contains three major parts such as a fluid carrier, pigments and resins. Technically, solvent ink refers generally only to the oil-based carrier portion of the ink that keeps the other components in liquid form and once applied to a surface through jetting evaporates.

By "UV curable Inks" is meant an ink that after printing is cured by exposure to strong UV-light.

By "refined fibres" are meant wood fibres which are only mechanically worked, i.e. not transparent and treated in a way that the lignin content is essentially unchanged.

By "processed fibres" are meant wood fibres that are processed in order to remove the lignin e.g. bleached and semi transparent. Processed fibres are preferably transparent in a cured binder.

Known Technique and Problems Thereof

FIG. 1 shows a known embodiment of the new "paper free" WFF floor with a solid surface 5 comprising a WFF mix of fibres, preferably wood fibres 14, small hard wear resistant particles 12,12' and a binder 19. The wood fibres are generally refined, mechanically worked, and of the same type as used in HDF and particleboard, i.e. treated in a way that the lignin content is essentially unchanged. They comprise natural resins such as lignin. The wear resistant particles (12,12') are preferably aluminium oxide particles. The surface layer comprises preferably also colour pigments 15 or other decorative materials or chemicals.

A preferable binder is melamine or urea formaldehyde resin. Any other binder, preferably synthetic thermosetting resins, can be used. The solid WFF layer 5 is generally applied in dry powder form on a wood based core 6, such as for example HDF, and cured under heat and pressure. The binder 19 penetrates into the upper part of the core 34 and connects the solid surface layer to the core.

A decorative pattern can be applied in line on a scattered or pre-pressed surface of a WFF mix with for example an ink jet digital device, which allows the ink to penetrate into the powder. A printed pattern with a high wear resistance can be obtained if the ink is included into the surface such that it penetrates below the top surface.

The major disadvantage is that such ink jet printing requires a considerable amount of ink and this increase the production costs. A deep high definition print with a resolution exceeding 100 DPI cannot be obtained since the ink floats vertically and horizontally along the fibres when it is applied on the powder layer.

OBJECTS AND SUMMARY

An objective of certain embodiments of the invention is to provide a building panel, preferably a floor panel with a solid surface comprising a WFF mix, which has better design properties and/or cost structure than the known building panels.

A first objective of certain embodiments of the invention is to provide a panel, preferably a floor panel, with a solid surface comprising a WFF mix, which has been applied in powder form on a substrate and which comprises an advanced high definition printed surface design, which can be combined with a high wear resistance.

A second objective of certain embodiments of the invention is to provide a cost efficient method to produce advanced surface designs.

A third objective of certain embodiments is to provide printing methods that can be use in powder based surfaces and where the print can be incorporated into the surface layer.

The above objectives are exemplary, and the embodiments of the invention may accomplish different or additional embodiments.

A first aspect of the invention is a method of manufacturing a building panel with a decorative surface layer. The method comprises the steps below and preferably performed in the listed sequence:

- applying a first layer of a mix, comprising fibres (14), a binder (19) and wear resistant particles (12), an optional colour substance, preferably a colour pigment, on a substrate, preferably a core (6);
- printing a first print with a first pattern on the first layer;
- applying a second layer of a mix, comprising fibres (14), colour substance, preferably a colour pigment, a binder (19) and wear resistant particles (12), on the first print;
- printing a second print on the second layer with a pattern that is essentially the same as the first pattern; and
- curing the layers and the prints by providing heat and pressure.

The panel and the production method according to embodiments of the invention make it possible to produce very advanced decorative patterns with high wear resistance in a cost effective way. The mix applied, as a first and/or a second layer can preferably comprise a colour substance, preferably a colour pigment.

A second aspect of the invention is a method of manufacturing a building panel with a decorative surface layer. The panel comprises a core and the decorative surface layer comprises a print applied on a mix comprising fibres, colour substance, a binder and wear resistant particles whereby the method comprises the steps of:

applying the mix comprising a dry base colour on the core;

printing the print on the mix; and spraying a liquid colour substance on the mix.

The decorative surface layer is according to the method described above obtained by a combination of a dry base colour, a print and a liquid colour substance. The advantage is that a part, preferably the major part, of the advanced decorative features can be obtained in a cost efficient way by using a base colour in the mix and by spraying a colour substance over the base colour or the printed base colour. The print, which preferably is made by digital ink printing, can be applied on only some parts of the surface and this can be used to increase printing speed and/or to reduce the ink content.

By printing (POD—Printing On Demand) the printed position of each ink drop is controlled by high precision.

By spraying by e.g. a nozzle the ink drops are randomly distributed over an elected area. A large area is faster to cover by spraying compared to POD.

A third aspect of the invention is a building panel comprising a decorative surface layer connected to a core. The decorative surface layer may comprise a print, fibres, an optional colour substance, preferably a colour pigment, a binder and wear resistant particles. The decorative surface layer comprises a first horizontal plane and a second horizontal plane below the first horizontal plane and a vertical plane perpendicular to the horizontal planes. The concentration of colour of the print, preferably along the vertical plane, may be higher in the second horizontal plane then the colour content in the first horizontal plane.

Such a panel can be produced with a high definition printed surface design that extends vertically below the upper parts of the surface layer and that maintains its decorative pattern when the surface is subjected to considerable wears.

A fourth aspect of the invention is a building panel comprising a decorative surface connected to a core wherein the decorative surface layer may comprise a print, fibres, an optional colour substance, preferably a colour pigment, a binder and wear resistant particles. The print is a high definition print having a printing quality of at least 100 DPI and a depth which is about the same as the thickness of the fibres.

Such decorative surfaces layer can be made with a print that extends into the surface to a depth that provides a wear resistance which is sufficient for flooring applications and that also provides a sufficient printing quality that can be used to for example print a wood design.

A fifth aspect of the invention is a method of manufacturing a building panel with a decorative surface layer. The panel comprises a core and the decorative surface layer may comprise a print applied on a powder mix comprising fibres, an optional colour substance, a binder and wear resistant particles, wherein the method comprises the steps below and preferably performed in the listed sequence:

applying a first mix comprising a first dry base colour on the core;

applying a second mix comprising a second dry base colour on first mix; and printing the print on the second mix.

The decorative surface layer is according to the method described above obtained by a combination of at least a first and a second mix that preferably comprises different base colours. The advantage is that the second mix can be applied on a part of the surface and a two colour base layer can be obtained that can, for example, provide a design similar to the basic design of wood. The wood grain design can be made with digital printing. The design effects can be improved by spraying a colour substance over the first and/or the second mix prior or after the digital printing. The print that preferably is made by digital ink printing can even in this embodiment be applied on only some parts of the surface and this can be used to increase printing speed and/or to reduce the ink content.

A sixth aspect of the invention is building panels comprising a decorative surface layer connected to a core wherein the decorative surface layer may comprise a digital print, and embossed surface portions. The panel surface comprises surface portions with a printed pattern that is in register with the embossing. At least two panels comprise surface portion with an identical embossing and with a printed pattern that varies between two panels.

The digital print is in this embodiment used to vary a pattern that is coordinated with an embossed press plate. The print can for example be made with a different colour or it can cover a larger or smaller part of the embossing. All panels or a majority of for example floor or wall panels can have individual designs that are partially or completely coordinated with an embossed surface structure that is made with the same press plate. It is preferred that the print is applied into a powder layer. The digital print can also be applied on a board or on a paper or foil material.

A seventh aspect of the invention is building panel comprising a decorative surface layer connected to a core wherein the decorative surface layer comprises a print. The panel surface comprises at least two layers with a printed pattern injected into at least the upper surface layer. The upper surface layer is semi transparent and the print extends vertically into the semi-transparent layer. A base layer is provided between the core and the surface layer, said base layer is partly visible through the surface layer.

This embodiment offers the advantages that a 3D pattern can be created where the print of the surface layer and at least some parts of the print/colour from the base layer are visible. The first and second layers can have different patterns or the same patterns that are offset against each other.

A high quality 3D visual print/effect may be obtained by combining transparent or semitransparent powder layers together with adding pigments or inkjet printing. A first print is provided on a base layer that can be the upper part of a board material or a powder layer that is applied on a substrate, preferably a board material. A second powder layer of transparent or semitransparent particles is applied on the base layer as a second print on the top layer. The first and the second print may have essentially identical patterns or decors. Alternative the first and the second print can have partially or completely different patterns or decors. Several transparent or semi transparent layers can be used and they can have different transparency or colour shadings. The resolution, drop size, ink type, printing method etc. can vary between the layers.

The surface layer may comprise a thermoplastic material, for example vinyl, which preferably is applied in powder form on a substrate. This allows that the print can be injected in the layer of plastic powder particles. An improved design and increased wear resistance can be reached when a print is injected into a plastic layer. Aluminium oxide particles or other wear resistant particles can be included into the plastic powder and this can increase the wear resistance further. Wood fibres, other fibres and decorative particles can be added into the plastic powder. The transparent plastic layer can also comprise alpha cellulose fibres, binders and aluminium oxide particles.

A powder based surface layer comprising thermoplastic particles may be applied on a core, preferably of plastic or wood, which may comprise one or several layers with different density. A so called LVT floor panel can be produced with a powder based and digitally printed surface layer.

An embodiment of the seventh aspect is a panel comprising a thermosetting and a thermoplastic surface layer.

A base layer comprising a mix of wood fibres and a melamine binder is applied on a core material, for example a HDF core. This base layer may also comprise a colour substance and/or aluminium oxide particles and preferably a print.

An upper powder layer comprising a thermoplastic transparent material such as vinyl particles preferably mixed with aluminium oxide particles is applied on the base layer. Several plastic materials in powder form can be used such as E-PVC, S-PVC, PVA, PET, PS, SAN, PMMA and similar.

The plastic powder should preferably have a glass transition temperature below the intended processing temperature and a melting point higher than the intended processing temperature. The plastic can further comprise functional groups such as hydroxy-, carboxy—and amino functionalities. Blends of plastics can also be used.

A print may be injected into the upper layer and the core with the two layers may be placed in a press where the surface layer is cured under heat, in the range of about 140-200° C. and pressure in the range of about 20-60 kg/cm2, preferably about 40 kg/cm2, in a so called hot-hot process, in about 10 to about 60 seconds, preferably about 15 to about 35 seconds.

The base layer may be used to provide impact resistance, a base colour and to fuse the upper plastic layer to the panel core. The upper plastic layer may seal the panel against moisture penetration and a very stable panel can be obtained, especially if a thermoplastic layer is applied on the rear side of the panel.

Powder layers may comprise a mix of wood fibres, thermosetting binders in powder form (for example melamine-, urea-, or phenolic-formaldehyde resins) and thermoplastic powder particles.

An artificial wood veneer may be produced by providing several layers comprising a mix of wood fibres and plastic particles. Such veneer can be glued to a core material.

A base layer of wood fibres and thermoplastic particles is provided in powder form. This first layer comprises preferably wood fibres of for example ash, oak, birch, pine or any other wood species. The fibres are used to give the basic colour and design structure. A print with preferably rather large ink drops may be included into the first layer.

The plastic layer can be used to create very glossy surfaces in floor and wall panels. A floor panel with a fibre based core can for example be produced in a two step process where a first layer comprising fibres, binders and preferably a colour substance and/or a print is produced by curing the surface layer with heat and pressure. A second powder layer comprising plastic particles in powder form is applied in a second production step on the cured fibre layer. The plastic powder comprises preferably aluminium oxide particles. A digital print is preferably injected into the plastic powder which is thereafter heated such that the plastic particles melt. The semi liquid plastic layer is cooled with a cooling device that can be a metal plate or cylinder. The cooling device can have an embossed or completely glossy surface. The first fibre layer is used to create a basic colour and to improve the impact properties of the panel.

Plastic powder can also be applied on the first fibre layer when the panel is hot after the pressing operation. No further heating is needed. A print can be applied on the hot semi liquid plastic surface and a second plastic powder layer can be applied over the print.

The gloss level of a pressed WFF product and conventional laminate flooring is generally controlled by the gloss level of the press plate, which is pressed against the surface during the curing of the resins. However, there are also other parameters that can be used to control the gloss level of the final product such as the material content and composition of the powder based WFF layer. A higher resin/wood powder ratio will for example have a positive effect and the gloss level can be increased if the resin content is increased. Digital printing can be used to change the gloss level in surface portions by applying and printing specific substances in different amounts into the powder prior to pressing. This method can be used to provide a matching between a printed design and the gloss level of various parts of the print. Controlled variations in the gloss level in the pressed surface can be obtained. The black parts in a granite stone design or the darker parts in a wood design can for example have a different gloss level than the lighter parts containing less ink or other types of ink or ink comprising a gloss controlling agent. By combining the gloss level control effect with the ink, a guaranteed perfect match between printed design and gloss level variations can be achieved. Gloss level controlling materials can also be applied in dry form into the powder. This method allows that repetition effects can be avoided since different gloss levels can be achieved with the same press plate. The variations in gloss level are most evident if the gloss of the press plate is in the range from so-called semi-gloss to a high-gloss level. The glossiness may naturally be verified by a visual inspection or by e.g. a ZGM Glossmeter 20, 60, 85.

An eighth aspect of the invention is a method to produce a decorative surface layer, which comprises portions with different gloss levels. The method comprises the steps below and preferably performed in the sequence listed:

- adapting a powder and an ink such that different gloss levels are obtained when the ink content varies and the powder with the ink is cured under heat and pressure;
- printing a print with ink drops on the powder layer such that surface portions are formed which comprise different contents of pigments or binders; and
- applying a press plate having essentially a uniform surface with an essentially uniform gloss level on the powder layer and the print.

A ninth aspect of the invention is a method to produce a decorative surface layer by printing with ink drops. The ink drops may be of variable size and/or variable colour and/or composition. The method comprises the steps below and preferably performed in the listed sequence:

- applying a base layer comprising powder on a substrate;
- positioning ink drops in the base layer at different vertically depths over each other; and
- applying a top layer comprising semi transparent powder on the base layer The method may comprise a further step of printing a second print with ink drops on the top layer such that the average size of the ink drops in the top layer is smaller then the average size of the ink drops in the base layer. The method allows that, for example larger drops can be applied deeper than smaller drops that are applied close to the surface. The large drops provide sufficient colour coverage and the small drops provide a high resolution. The larger drops can be provided with print heads that can handle larger pigments. Larger drops allow that that ink with larger pigment size can be used and this will generally give a better saturation.

The small colour pigments may not be larger than 0.001 mm. Fibres should have an average a length of less than 0.5 mm and a thickness of less than 0.05 mm.

A tenth aspect of the invention is a method of manufacturing a building panel with a decorative surface layer. The method comprises the steps of:

applying a layer comprising a powder on a substrate;

printing a print with ink drops in the powder; and positioning the ink drops in the surface layer at different vertically depths.

The method provides a possibility to produce a building panel with a decorative surface layer with 3D visual effect produced by printing in only one layer. The ink drops 11 may be positioned over each other. The ink drops may be of variable sizes.

The larger ink drops may be positioned over smaller ink drops.

The layer may comprise bleached wood fibres and wear resistant particles cured with a thermosetting binder.

The layer may comprise wood fibres, wear resistant particles and a thermoplastic material. If the wood fibres are refined virgin wood fibres, the fibres may provide a natural base colour and the print may be a natural wood graining, preferably of the wood species of the refined virgin wood fibres. In an embodiment the decorative surface layer produced may look very much as an original wood veneer of said wood species.

An eleventh aspect of the invention is a method of manufacturing a building panel with a decorative surface layer. The panel comprises a core and the decorative surface comprises a print applied into a powder layer. The method comprises the steps below and preferably performed in the listed sequence:

forming a mechanical locking system in the core;

applying a powder layer on the core; and printing a pattern into the powder layer.

This methods allows that a large pattern can be formed that comprises several panels. The problems related to the positioning and forming of a locking system and the adjustment of the design due to material waste of surface material can be eliminated. The method may comprise an intermediate step where the panels are connected prior to the application of the powder layer. This makes it possible to cure or form the powder surface on large boards comprising several panels that are connected to each other. The surface may for example be cured by heat and pressure. The surface layer will crack along the panel edge when the panels are disconnected and the panels can be used without further machining of the edges. However, some further machining can be made in order to for example polish the edges or to make small bevels. This limited machining will generally not have any effect on the large pattern, that in spite of the fact that it comprises several panels, will look as one single large pattern or picture that can cover a large area of a floor or a wall. The panels can be marked, preferably with a digital print on the rear side, and this will facilitate installation.

Powder layers or a powder mix may in all eleven aspects of the invention comprise several combinations of materials and chemicals and additional layers of such material combinations may be included for example:

The layer may comprise essentially only one material such as small vinyl particles. No binders, pigments or wear resistant particles are needed in order to create a surface layer or a sub layer.

Vinyl particles may be combined with a colour substance and/or fibres and/or wear resistant particles. Decorative particles can also be included in this mix.

The layer may comprise a mix of fibres and binders. The fibres are preferably refined wood fibres, but may also be processed wood fibres or refined and processed wood fibres.

Fibres may be mixed with resins, for example thermosetting resins preferably melamine formaldehyde resins, thermoplastic resins or thermoplastic particles such that they can be connected to each other when for example heat and/or pressure is applied on the layer.

A fibre/resin mix can comprise wear resistant particles and/or a colour substance. Decorative particles can also be included in this mix.

Embodiments according to all aspect of the invention may comprise a powder layer with wear resistant particles comprising aluminium oxide, silica and/or flour of stone.

Embodiments according to all aspect of the invention may comprise curing of a powder mix layer comprising applying heat, in the range of about 140-200° C. and applying pressure in the range of about 20-60 kg/cm2, preferably about 40 kg/cm2, in about 10 to about 60 seconds, preferably about 15 to about 35 seconds.

The following methods may be used separately or in combinations to cerate a digital print in the embodiments of this disclosure.

The ink may be a "spot color" ink. The ink has in such an embodiment been specifically produced and adapted to a specific color suitable for a specific image. Instead of creating the color by mixing pixels of cmyk-colors the ink creating the spot color pixel has a specific predetermined color.

The print may be a "full print." This means that the visual printed décor is mainly created by the ink pixels applied into the powder. The colour of the powder has in such an embodiment in general a limited effect on the visible pattern or décor.

The print may also be a "part print". The color of the powder, the board or another underlying layer is one of the colors that are visual in the final décor. The area covered by printed pixels and the amount of ink that is used can be reduced and cost savings can be obtained due to lower use of ink and increased printing capacity compared to a full print design.

The print may be based on the CMYK colour principle. This is a 4 color setup comprising cyan, magenta, yellow and black. Mixing these together will give a color space/gamut which is relatively small. To increase specific color or the total gamut spot colors can be added. A spot color can be any color. Additional colours such as orange, green, blue, red, light grey, and light colors of magenta and cyan or white can be used. These colours can be used separately or in combinations. The colors are mixed and controlled by software/hardware (print engine/print heads)

A high definition print in a powder layer requires a specific software program in order to control the printing hardware and to adopt it to the specific ink, printing method, distance from the printing head to the powder layer and the powder that is used. This software program is hereafter called "Digital Powder Raster Image Process" or DP-RIP and it is used to control printing speed, ink drop position, ink drop size and shape.

DP-RIP:s can be developed that allow that a print or decor can be positioned in several dimensions in powder horizontally and vertically in different depths. This can be used to create 3D effects and to increase the wear resistance. A specific advantage is that the print is extending from the upper part of the surface layer and downwards. This allows that a part of the print will always be at the surface even when a part of the surface is worn down. No protective layers are needed that disturbs the original design.

This new type of "Digital Injection Print" or DIP is obtained due to the fact that printing is made into a powder that is cured after printing. The print is embedded into the cured layer and is not applied on a layer as when conventional printing methods are used.

The DIP method may be used in all powder based materials, for example moulding compounds and similar plastic materials, which can be cured after printing. However, the DIP method is especially suitable to be used when printed powder layers have a thickness of about less than a few mm, preferably less than 1.0 mm are applied on a board material that can have a width of about 1.2-2.2 meters and a length of about 2.4-2.6 meters. Printing may of course also be made on individual panels, for example wall or floor panels or furniture components.

The thickness of the powder layers and the size of the powder particles in a high definition print, which requires several layers in order to create the necessary wear resistance, is an important part of the DIP method. The reason is that a high definition print requires a rather small drop size and such small drops can only be injected to a limited depth into the powder. Large powder particle will prevent the ink drops to penetrate below the upper surface of such large particles. It is preferred that the powder particles are small. Fibres should have a mean thickness of about less than 0.05 mm and an average length of less than 0.5 mm. Melamine powder and pigments should not exceed an average size of about 0.01 mm and wear resistant particles should have an average size of less than about 0.1 mm. The thickness of the printed and pressed layer should preferably be less than 0.1 mm and even more preferably less than about 0.05 mm especially when the layer is a top layer.

The fiber size may be measured in different ways:

An actual individual fiber could be measured in diameter and length.

A fiber size could be defined by the size of the mesh of the net in the sieve in which the fibers are separated by size and the wanted fraction is sorted out.

For refined fibers used in a wood fiber floor produced from an hdf-board the typical production steps are:

To bring down the hdf-boards to flakes in a pre mill

Bring down the flakes to the wanted size in a hammer mill

Sieve the fibers in a net with a mesh size of 0.3 mm. Often such fibers are defined to be less than 0.3 mm in size. The diameter could though of course be less and the length could be longer due to the elongated shape of the fiber.

The distribution of the fiber sizes after sieving could be defined by measurements of the fibers.

For processed fibers (for example bleached fibers) the mesh size used is often smaller than the one for refined fibers. The size of the fibers is defined by the distribution of the sieved material. A typical distribution of fibers size is:

>32 μm 43.6%

>90 μm 9.3%

>160 μm 0.4%

The distance from the printing head to the uncured powder layer is important for the printing quality and production costs. Static electricity can create production problems if the print head is positioned close to the powder surface. On the other hand a large distance and small drops will result in an inaccurate print pattern especially in a dusty environment and where airstreams may occur. This problem can be solved by for example adapting the powder such that it is distributed accurately on the substrate and stable when it is under the printing head. This allows that the print head can be positioned at a distance from the powder which is less than 10 mm. A preferable distance is 2-5 mm.

The carrier for the powder layers may be a board material such as HDF, particle board, plywood, a plastic or mineral based core, a paper, a plastic foil or foam, a wood veneer, a cork layer and similar materials and combinations of these materials for example paper or wood veneer applied on a board material. Several core materials that generally are not used in conventional laminate production can be used when for example plastic powder is applied as a layer or when a separate surface layer is produced and glued to a core since the heat and applied pressure on the core can be reduced considerably or even eliminated. Heat can be applied with for example infra red light, hot rollers and similar.

Liquid preferably mainly water based chemicals or steam may be used prior or after the printing in order to stabilize the powder prior to printing or prior to pressing. Such stabilizing can also be obtained with separate ink heads that apply a suitable liquid substance. An extremely well distributed liquid substance can be applied with controlled drop size and this will improve the surface quality.

The DIP process itself can be used to stabilize and seal the upper part of the powder and preventing it from blowing away during pressing. A seal may be obtained if the ink, for example, comprises a binder or if the ink causes some parts of the powder mix to melt or glues together the powder particles. A melamine formaldehyde binder can, for example, be used together with a water based ink and this will cause the melamine particles to melt and to bind the fibres, aluminium particles and colour pigments to a crusty and rather hard upper layer.

The cost of the ink can be reduced if, for example, the binder content of the ink can be reduced or eliminated. The decreased content of binder may be exchanged to pigments instead to increase color gamut. Such a reduction can be obtained with a powder mix that comprises suitable binders that are used to bind the ink but also all other powder particles. The DIP method allows that binder free or essentially binder free inks can be used.

A control of the drop size is an essential part of the DIP method. Small drops, under 5 picoliters should preferably be used in high resolution prints and a high quality seal of the powder surface can be obtained. Bigger drops, for example 5-20 picoliters, will penetrate deeper in the powder layer as they have a bigger mass. They can also be fired from a greater distance, up to 25 mm from the powder surface. Bigger drop sizes can also allow bigger particle size in the ink and this can give more power (gamut) to the ink. However bigger drops will also take longer time to shoot, with less resolution. This can be used to optimize a design. Small drops can be applied on the top layer and bigger drops can be applied in layers under the top layer.

A suitable printer head has to be used in order to obtain a high printing quality and speed in powder base layers. A printer head has several small nozzles that can shoot droplets of inks in a controlled way (Drop On Demand—DOD). The size of each droplet can vary, dependant on ink type and head type, between normally 1-100 picoliters. Some printer heads can shoot different droplet sizes and they are able to print a grayscale. Other heads can only shoot one fixed droplet size.

Different technologies can be used to shoot the drops out of the nozzle.

Thermal printer head technology use print cartridges with a series of tiny chambers each containing a heater, all of which are constructed by photolithography. To eject a droplet from each chamber, a pulse of current is passed through the heating element causing a rapid vaporisation of the ink in the chamber to form a bubble, which causes a large pressure increase, propelling a droplet of ink out through the nozzle to the substrate. Most consumer inkjet printers, from companies including Canon, Hewlett-Packard, and Lexmark use thermal printer heads.

Most commercial and industrial inkjet printer heads and some consumer printers such as those produced by Epson, use the Piezoelectric/piezoelectric printer head technology. A piezoelectric material in an ink-filled chamber behind each nozzle is used instead of a heating element. When a voltage is applied, the piezoelectric material changes shape, which generates a pressure pulse in the fluid forcing a droplet of ink from the nozzle. Piezoelectric (also called Piezo) inkjet allows a wider variety of inks than thermal inkjet as there is no requirement for a volatile component, and no issue with kogation. The print heads are more expensive to manufacture due to the use of piezoelectric material (usually PZT, lead zirconium titanate).

Multipass printing, also called scanning printing, is a printing method where the printer head moves transverse over the substrate many time to generate an image. Such printers are slow but one small print head can generate a bigger image Single pass printing uses fixed printer heads, with a width that corresponds to the width of the printed media, and the substrate moves under the heads. Such printers have a high capacity. HDF boards used in flooring production have generally a width of 1.4-2.2 m. A high capacity single pass printer should therefore cover a considerable width. Such printers can be custom made for each application.

A lot of ink types can be used to print in powder based layers such as dye inks, solvent based inks, latex inks or UV curable Inks.

Inks are generally individually mixed together by using several chemicals. Water based inks are suitable to use in a DIP process. An example of such a water based ink mix is shown below.

| Ink Component | Weight in % | Ink Function |
|---|---|---|
| Water | 50-90 | Carrier |
| Colorant | 1-15 | Color |
| Co-sovent/Humecant | 2-20 | Evaporation |
| Fixative | 0-10 | Fix ink to substrate |
| Surfactant | 0.1-6 | Adjust surface tension |
| Binder | 0.2-10 | Durability, Adhesion |

The ink may also comprise rather small portions of chemicals 0.01-1% that prevent bacterial and fungal growth, corrosion and contamination and that control pH.

Most industrial single pass printers, which are used to for example to print ceramic tiles, have a width of 0.6-0.8 m. Two or three of such printers can be positioned side by side in a flooring line. Most floor designs, such as wood and tile designs, have a width of about 0.2-0.4 m. The pressed board is, after pressing, sawn in a first step to such widths prior to the machining of the edges. This can be used to eliminate the need for a perfect coordination between different printers since the printers can work individually and the saw cut line can be used to separate the prints.

The most preferred combination is a single pass printer and water based inks.

The major advantages of the DIP method over conventional digital printing methods is the possibility to combine the flexibility that digital printing provides with high impact and wear resistance, deep embossing and clear advanced designs that are not disturbed by protective layers over the print. All these advantages are mainly obtained due to the fact that ink drops are injected into powder that after printing is cured to a solid surface layer.

Embodiments and details of various aspects can be combined with embodiments and detailed of the other aspects.

BRIEF DESCRIPTION OF THE DRAWINGS

The invention will in the following be described in connection to preferred embodiments and in greater detail with reference to the appended exemplary drawings, wherein, FIGS. 1*a-b* Illustrate a known WFF panel and a know digital printing method.

DETAILED DESCRIPTION OF EMBODIMENTS

Figure 1A:
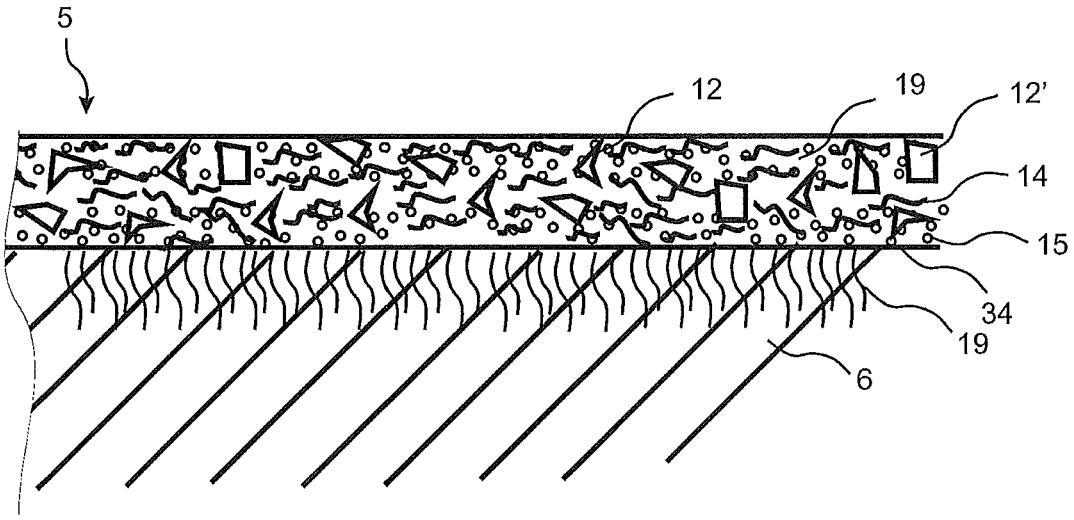

FIG. 1*a* shows the upper part of a known Wood Fibre Floor—WFF—as described in WO 2009/065769 (Applicant Välinge Innovation) with a solid decorative surface 5 comprising a mixture of fibres, preferably wood fibres 14, small hard wear resistant particles 12, 12', preferably aluminium oxide, and a binder 19, preferably thermosetting resin such as for example a melamine formaldehyde resin. A wide variety of designs can be obtained by mixing colour substances such, as for example, colour pigments with fibres, binders and aluminium oxide particles in dry form and by applying the WFF mix as powder on a core that is cured in a press under heat and pressure. Such a mix of materials comprising fibres, preferably wood fibres, binders, wear resistant particles and an optional colour substance that is applied as powder on a carrier is hereafter referred to as a "WFF mix". A mix that only comprises wood fibres and binder in powder form is hereafter referred to as a "Wood powder mix" such a mix can be used in applications where a high wear resistance is not needed for example in wall panels or furniture components.

Figure 1B:
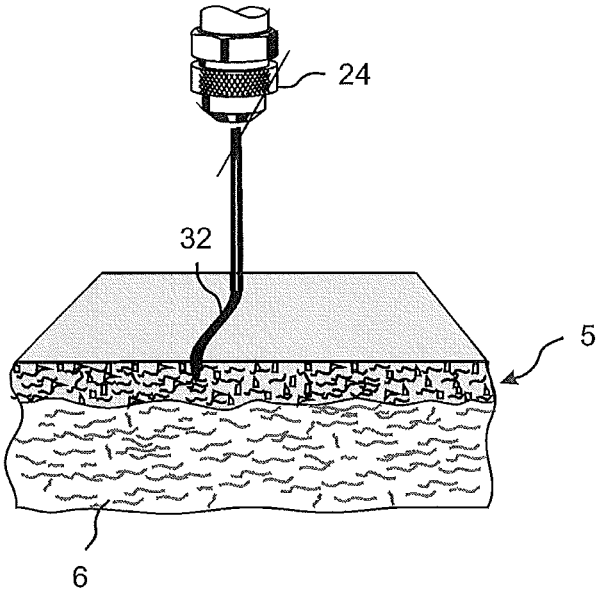

FIG. 1*b* shows a known digital printing method, which is described in WO 2009065769. A digital ink jet printing head 24 can be used to print a pattern on and into the powder before pressing such that the ink 32 penetrates about 0.1-1 mm into the powder.

Such a method may for example be used to print grout lines and to create a tile pattern. The ink can penetrate deep into the powder and a printed pattern with a high wear resistance can be obtained. Rough wood grain structures can also be formed.

A deep print can be provided in several ways.

Ink may be used that penetrates into the fibres and that flows around and between the fibres. A deep penetration of for example 0.1-0.5 mm can be obtained if a sufficient amount of ink is applied on the powder. Such deep penetration can give a very high wear resistance. High quality laminate floorings have a wear resistance of 4000-6000 revolutions, which corresponds to the abrasion classes AC4 and AC5 measured with a Taber Abraser according to ISO-standard.

A deep print in a powder based surface can be made that can obtain a wear resistance of 30,000 to 50,000 revolutions.

Figure 2A:
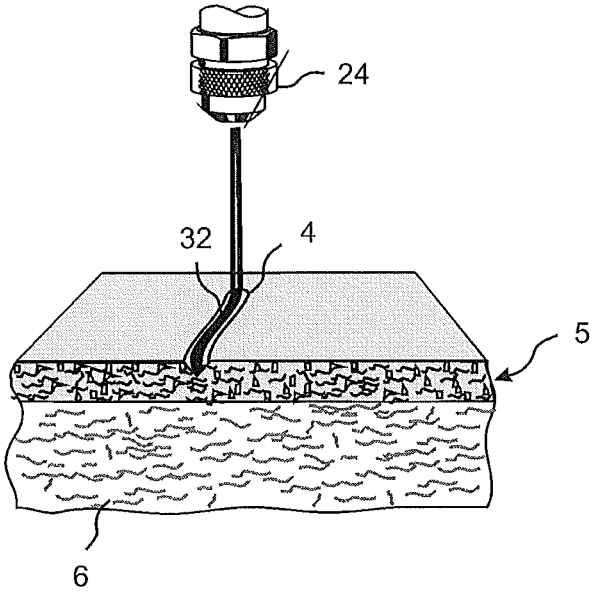
FIGS. 2*a-b* Illustrate a method to form a decorative surface with a deep print.
Figure 2B:
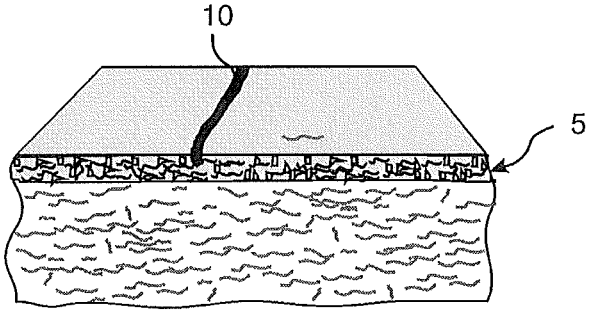

FIG. 2 a shows that ink can also be applied by an ink head 24 with pressure that removes the powder based WFF mix 5 and forms a V or U formed groove 4. The walls and the inner lower parts 32 of the groove are coloured by the ink. A deep print 10 is obtained after pressing as shown in FIG. 2*b*. The ink head 24 is shown schematically.

A high definition digital printer with a resolution of for example 300 DPI sprays about 12 ink dots per mm that are about 0.05 mm wide.

Figure 3A:
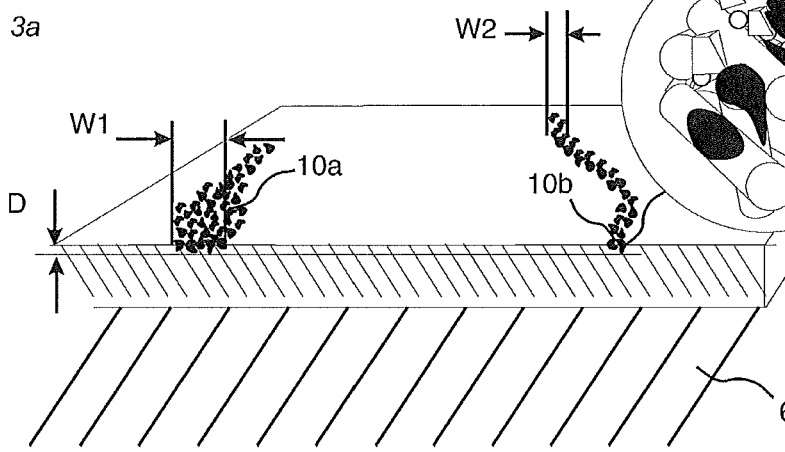
FIGS. 3*a-e* Illustrate panels having a decorative surface with a digital print.
Figure 3B:
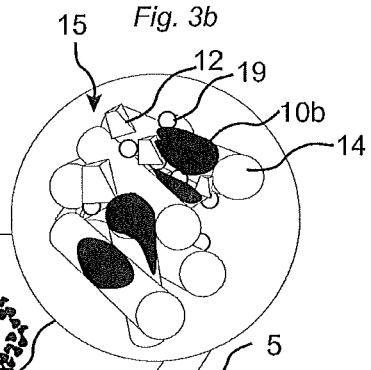

FIG. 3*a* shows that a digital ink-printing device may be used to create a high definition print 10*a*, 10*b* in a WFF mix 5 or a wood powder mix that does not comprise any wear resistant particles. FIG. 3*b* shows that the ink can be applied as a print 10*b* on all parts that are included in the mix. Fibres 14, preferably aluminium oxide particles 12 and melamine particles 19 are printed. The mix preferably also comprises a colour substance 15 (not shown) that provides a base colour. Such print can be made with the same quality as printing on paper especially if the drop size and the drop volume of the ink are adapted to the mix structure and the size of the fibres. The drop volume is measured in picoliters ($1/1{,}000{,}000{,}000{,}000$ of a litre) and can vary from for example 1 to 50 picoliters. The quality can be increased further if the powder for example is pre pressed before printing such that the fibres are not displaced horizontally during the final pressing and/or if small wood fibres with for example a width of less than 0.05 mm and length of less than 0.5 mm are used. The ink content can be rather low and the ink can be applied in a way that it is not floating along the fibres and between the fibre layers. The ink is during pressing mixed with the binders and partly pressed to the fibres. Such high definition print with a printing quality of 100 DPI and more can be obtained with a depth D that preferably is equal to the thickness of the fibres. The depth D of the print is about the same in prints 10*a* that have a considerable width W1 of for example 1 mm and more as in prints 10*b* that are similar to thin lines with a width of for example 0.1 mm.

The wear resistance of a high definition print applied on a powder based WFF mix as described above and with a depth D of 0.03-0.05 mm can be about 2,000-3,000 revolutions provided that the mix comprises a sufficient content of wear resistant particles, for example 10-20% (weight) aluminium oxide particles. This exceeds AC 3 (>2,000 revolutions) and is sufficient for domestic applications.

Several methods can be used to increase the wear resistance further.

Figure 3C:
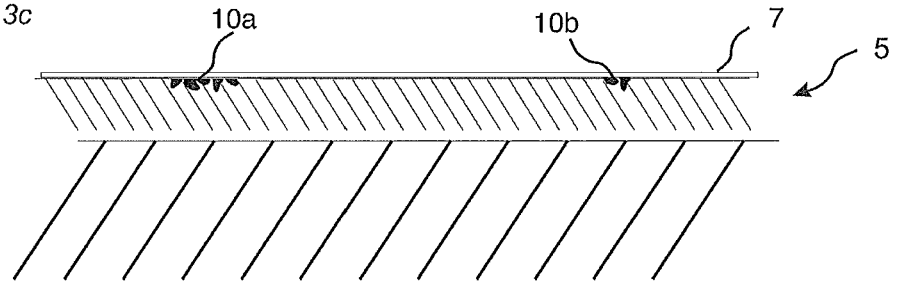

A transparent wear layer 7 can be applied over the print 10*a*, 10*b* as shown in FIG. 3*c*. Such wear layer can preferably comprise wear resistant particles preferably transparent aluminium oxide particles or a binder for example melamine or a mix of for example melamine powder and aluminium oxide particles that can be pressed into and on the print. This method can be used to increase the depth of the print and/or to increase the content of the wear resistant particles in the upper part of the surface. Even transparent or semi transparent alpha cellulose fibres can be included in the mix that can be applied as a dry powder layer or in liquid form. Conventional overlay used in conventional laminate flooring can also be used.

Figure 3D:
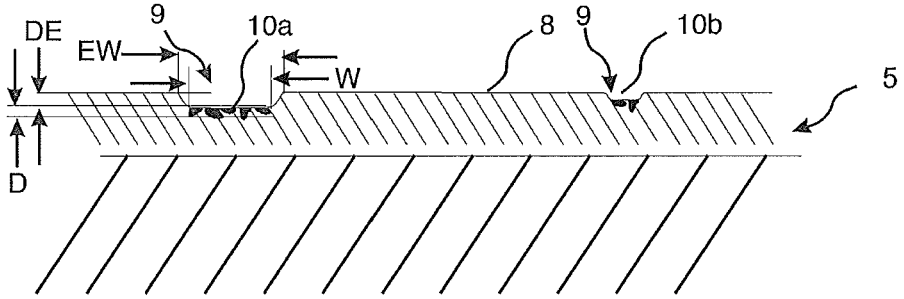

FIG. 3*d* shows that the print 10*a*, 10*b* can be coordinated with an embossed surface. Such coordinated embossing can be very accurate and the tolerance between the print 10*a* and the embossed portions 9 can be much better than in conventional laminate where the printed paper swells during impregnation in an uncontrolled way and where the positioning of the paper increases the tolerances further. Coordinated embossing or embossing in register in powder based surfaces as described above can be made with a tolerance that is less than 1.0 mm. A long and short edge of the board can be used as reference during printing and pressing. Printed positioning spots or lines can also be used. The print can be positioned very precisely in the lower parts of the embossed surface portion 9. The upper parts of the surface 8 will protect the print 10*a*, 10*b* from wear. The width EW of the embossed portion 9 can be made larger then than width W of the print 10*a* in order to eliminate production tolerances and to assure that the printed pattern is protected by surface portions, which are located above the print. The depth DE of the embossed portion can be about 0.05-0.10 mm and this is generally sufficient to increase the wear with for example 2000-4000 revolutions. A WFF mix allows that very deep embossing with an embossing depth DE of for example 0.10-1.0 mm can be formed and this can be used to produce floor panels with a very high wear resistance.

Figure 3E:
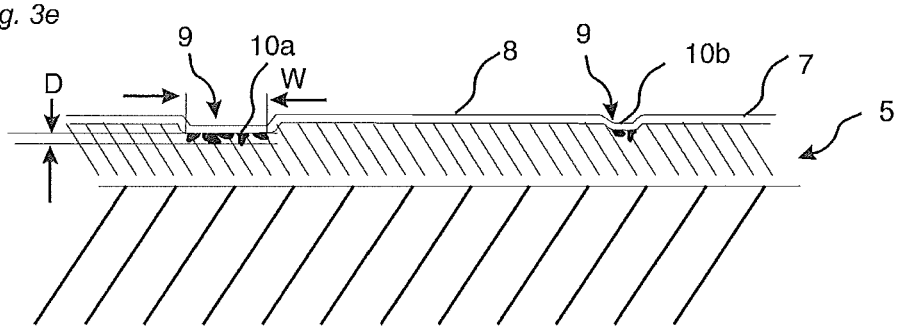

FIG. 3*e* shows that all the described methods can be combined. A transparent wear layer can for example be provided over the embossed parts 9 with the print 10*a*, 10*b* located in the lower part of the embossing.

The ink content can be much lower than in other conventional digital printed surfaces where ink is applied on a paper. The powder in the WFF mix can be coloured with a base colour or several colours that are mixed together. A powder layer with one colour can be applied in patterns on another powder layer having a different colour. Such colours or combination of colours can for example provide the base colour or base pattern of a wood design. Only a very limited amount of ink is needed to for example create a wood grain structure on the base pattern or colour. The ink can cover less than 50% of the design. In some applications less than 30% or even less than 10% can be sufficient to obtain a wood design. Additional decorative substances can be sprayed over the base colour prior and/or after the printing step. Very advanced designs can be created with a combination of one of several powder layers comprising one or several base colours, digital ink jet printing and spraying of one or several colour substances.

Figure 4A:
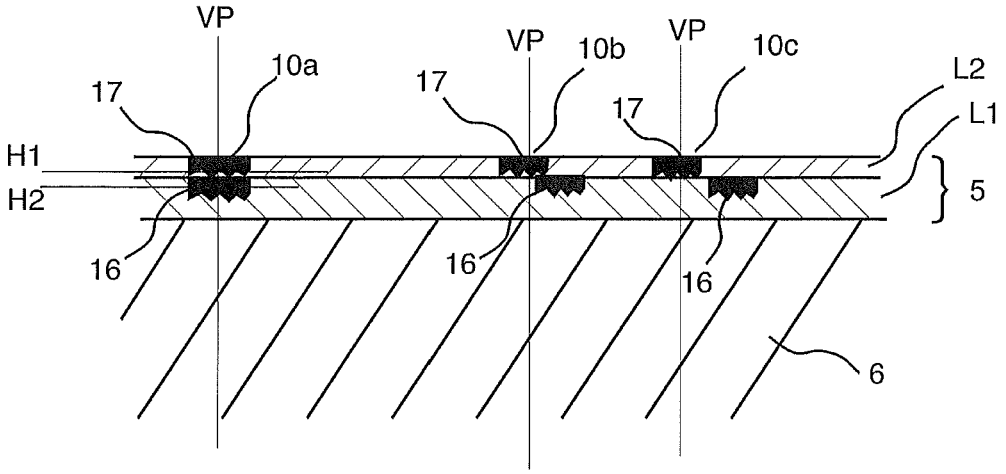
FIGS. 4*a-b* Illustrate panels having a decorative surface with a high definition print that extends deep into the surface.

FIG. 4*a* shows that a high definition print 10*a* can be combined with a high wear resistance. The first print 16 is provided on a first powder layer L1. A second powder layer L2 is applied on the first layer L1 and a second print 17 is provided on the second powder layer. The prints are positioned over each other such that parts of the two prints are preferably connected vertically. The wear resistance can be increased considerably and a high definition print with a wear resistance of for example 6,000 revolutions equal to AC 5 can be obtained. Such surface quality can be used in commercial applications. The surface layer 5 comprises a first horizontal plane H1 and a second horizontal plane H2 under the first horizontal plane H1 and a vertical plane VP perpendicular to the horizontal planes. The colour content of the print 10 is in this embodiment higher in a second horizontal plane H2 than in a first horizontal plane H1 located over the second horizontal plane. It is preferred that such variation of the colour content varies along the vertical plane VP. This means that the prints 16, 17 are positioned above each other and that the pattern will be substantially the same when the surface is subjected to wear. The prints 10*b*, 10*c* can also be made with a first 16 and a second 17 print that are offset but in contact or completely offset without contact along the vertical plane. The printed pattern will vary when the surface is subjected to wear. The two prints can have different designs. The colour and/or the pattern can for example be different in the first layer compared to the second layer.

The second layer L2 comprises preferably a WFF mix of 50-100 gram/m2.

Figure 4B:
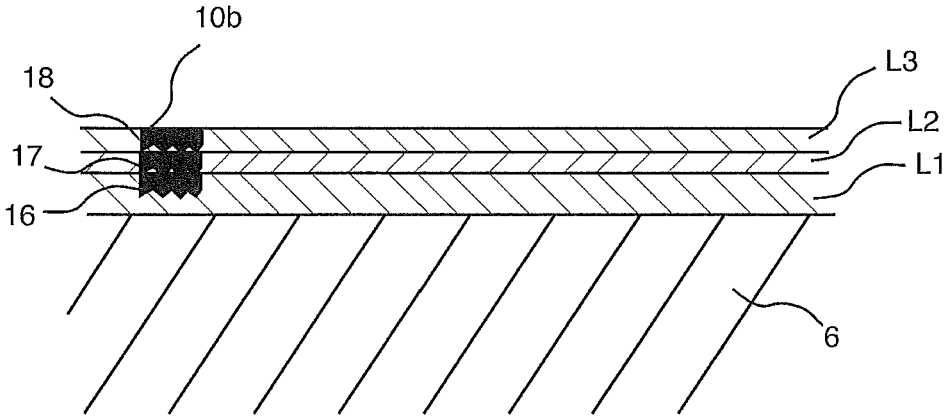

FIG. 4*b* shows that three prints provided on three layers can be used to reach a high definition print with a wear resistance of 9,000 revolutions similar to AC 6 (>8,500 revolutions).

It is for example possible to apply 4-10 layers and prints and this makes it possible to create a surface with the same structure as a solid wood veneer where the wood grains designs extend from the top to the bottom of the surface layer. The wear resistance can be extremely high and 20,000-30,000 revolutions can be reached.

Digital prints in one or several layers can be applied on a mix comprising different material compositions. All materials described above can be combined or used separately. A first and/or a second layer can for example comprise a mix of:

Only plastic particles;
Plastic particles with a colour substance;
Plastic particles with wear resistant particles;
Only fibres;
Only binders;
Only wear resistant particles;
Only a colour substance;
Fibres and a binder;
Fibres and a colour substance;
Fibres, binders and wear resistant particles;
Fibres, binders and a colour substance; or
Fibres, binders, colour substance and wear resistant particles.

Other materials such as fibres and/or colour substance and/or wear resistant particles and/or binders can be added after a first and/or a second print etc.

The binders in one layer can be used to cure a second layer since the binders will during pressing float between different layers.

The principles described above can be used to produce a panel where the powder and a print are applied on a core material. The principles can also be used to produce separate surface layers that can be glued to a core.

The principles can also be used in combination with other printing methods.

Digital ink printing can in all embodiments as described above be combined or replaced by other printing methods such as transfer printing, stamp printing and similar know methods.

Some or all of the layers L1, L2 and L3 can comprise transparent or semi transparent fibres preferably processed and bleached wood fibres. This can be used to create 3D effect as described in other sections below.

Wood fibres and transparent or semi transparent alpha cellulose fibres can in all embodiments of this invention be replaced by thermo plastic powder, preferably vinyl powder. A binder is in such an embodiment not needed. It is preferred that such plastic particles have a diameter of about less than 0.3 mm, even more preferably about less than 0.1 mm. A digital print can be applied in one or several layers preferably comprising a transparent plastic mix of vinyl powder and preferably also wear resistant particles for example aluminium oxide particles. The plastic layers are exposed to heat and preferably also pressure. The surface is thereafter cooled and a perfect 3D design can be obtained with perfect visibility between the different transparent layers. A flexible plastic surface can be obtained with ink particles embedded into a plastic layer and such a surface layer can be combined with all types of core materials, preferably mineral based board materials, plastic boards or board material for exterior application that are not sensitive to moisture variations. Swelling and shrinking of the board and the surface in different humidity conditions can be avoided. It is preferred that the board surface is not visible. This can be obtained in several ways. The board can be coloured or coated with an impregnated paper. A plastic coloured sub layer can also be used as a base for the transparent layers. The plastic layers can also be mixed with wood fibres, preferably bleached semi transparent alpha cellulose fibres.

Figure 5A:
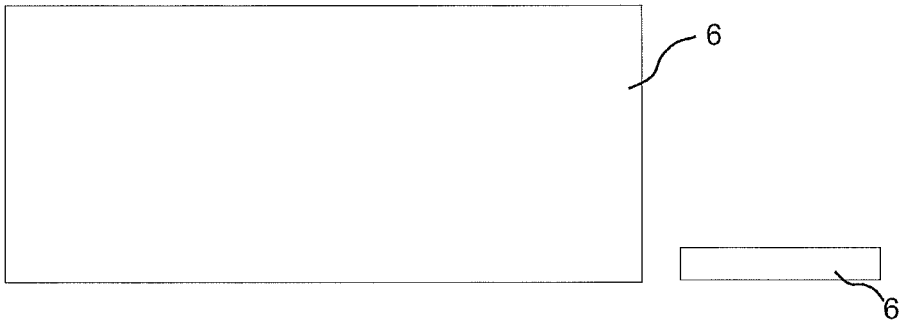
FIGS. 5*a-e* Illustrate a method to make a decorative surface with a combination of a base colour, a print and a liquid colour substance.
Figure 5B:
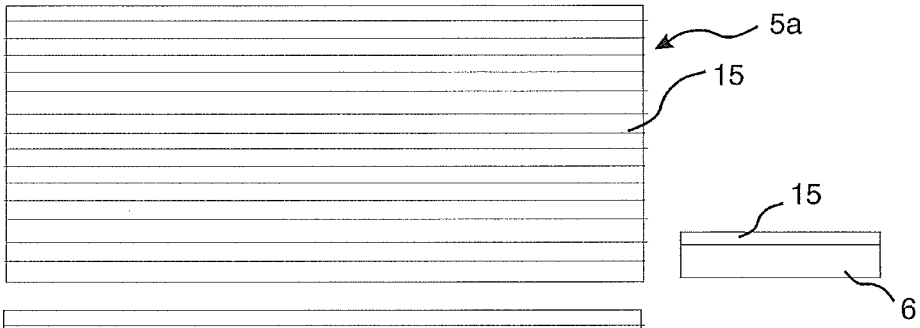
Figure 5C:
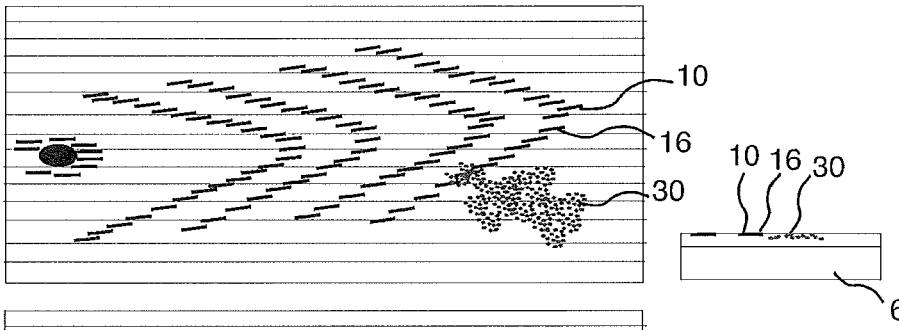
Figure 5D:
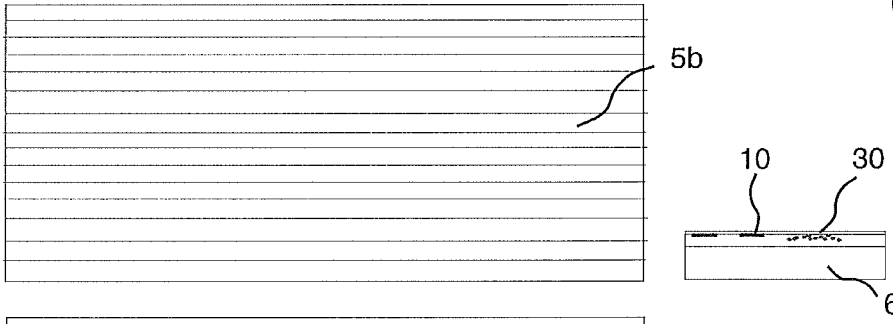
Figure 5E:
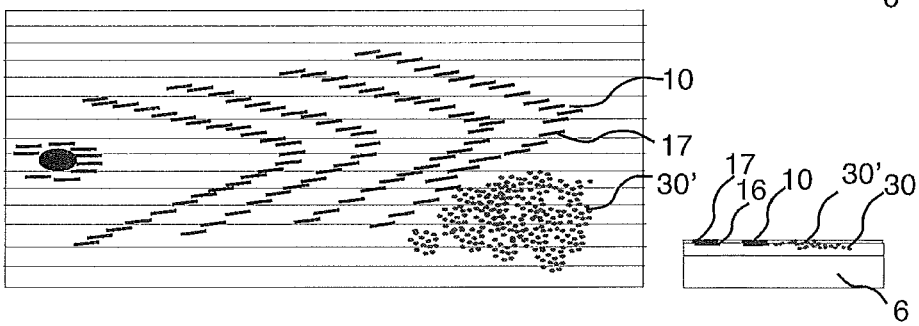

FIGS. 5*a*-5*e* show how a surface design can be formed that comprises a high definition print 10 that has a high wear resistance. A WFF mix 5*a* is applied on a carrier, for example a HDF core 6 as shown in FIG. 5*b* as a base layer. The mix comprises a base colour 15. A first digital ink print 16 is preferably applied on the base layer as shown in FIG. 5*c*. The ink can be water or solvent based. A liquid colour substance 30 is preferably sprayed on the first print and the base colour. Spraying can be used to coat the mix with small drops that are not individually controlled as in digital printing. Spraying can be used to create specific patterns with small drops that are applied at random within specific surface portions. A new WFF mix 5*b* is applied as a second layer on the first print 16. The second layer can have the same composition as the first layer. It can also have a different composition. The amount or size of the aluminium particles and/or binders can be different. The second layer has preferably a higher content of binders and/or wear resistant particles than the first layer. The thickness of the second layer is preferably 0.01-0.1 mm. This corresponds to about 10-150-gram/m2. A second print 17 is preferably applied on the second layer 5*b* as shown in FIG. 5*e* and a second liquid colour substance 30, is preferably sprayed over the second print.

Spraying of colour substances on one or several layers of a WFF mix can be made without printing in order to improve the decorative properties of the decorative surface layer 5. Wear resistant particles can be excluded if for example the intension is to produce panels for vertical or decorative applications.

Figure 6B:
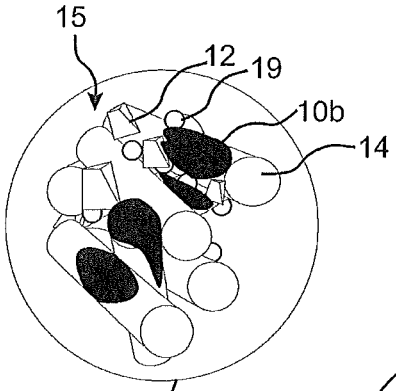
FIGS. 6*a-d* Illustrate methods to form a decorative surface.
Figure 6C:
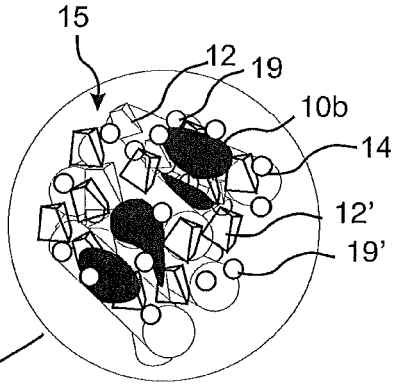
Figure 6A:
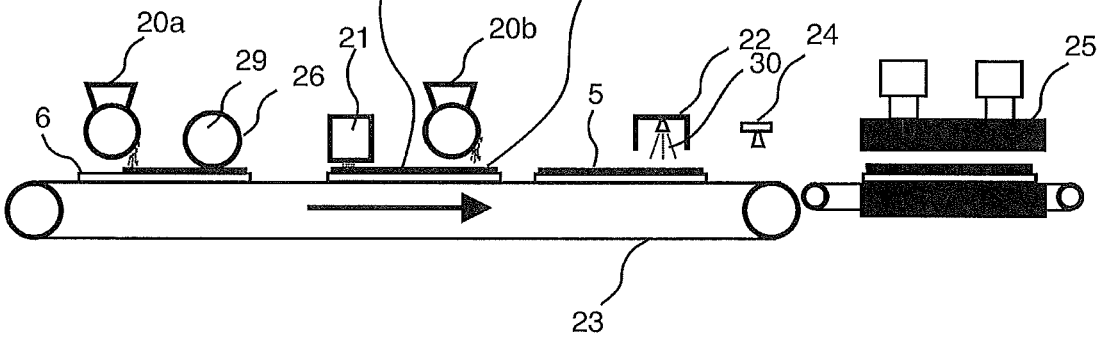

FIG. 6*a* shows schematically a production line for production of a building panel comprising a decorative surface 5 connected to a core 6. A conveyor belt 23 moves the board 6 such that it passes several scattering station 20*a*, 20*b*. A scattering device 20*a* applies a WFF mix or a wood powder mix as a dry powder on a carrier 6 that preferably is sheet material, for example a HDF board. The mix is preferably pre pressed and the pre-pressing device is in this embodiment preferably a roller 29. Alternatively a discontinuous or continuous pressing device can be used. A balancing layer of for example impregnated paper or a powder layer is preferably applied prior to this first scattering provided on the rear side of the core 6.

A particular problem with pre pressing is that WFF powder will stick to the pressure surface 26 of the pre-pressing device 29 that is in contact with the powder. The fibres of the pre pressed surface will not form an even base for the print. This problem can be solved if the pressure surface 26 is a high gloss steal roller, band or plate. Sticking problems can be reduced or avoided with very high gloss pressure surfaces 26. A mix with low moisture content, preferably less than 6%, is also favourable in order to eliminate sticking problems.

A decorative pattern is provided on the WFF mix by a digital ink printing device 21. The print 10*b* is applied on the fibres 14 and all other parts included in the mix as shown in FIG. 6*b*.

Preferably a second scattering station 20*b* applies transparent aluminium oxide particles 12' and/or melamine powder 19' over the print 10*b*. A stabilizing unit 22 sprays a liquid substance preferably a water solution comprising de-ionized water over the WFF mix and the print 10*b*. This spaying prevents the powder to be displaced and to blow away during the final pressing operation. The stabilizing unit 22 can also comprise several spray heads that can apply one or several liquid colour substances 30 on the surface 5 in order to improve the decorative effects. A heating device 24 can be used to remove water from the colour or the water based stabilizing substance that is applied prior to pressing. The heating is preferably made with infra red lights. The core 6 and the printed surface 5 are finally pressed in a press 25 under heat and pressure such that the WFF powder and the print cures to a hard and wear resistant decorative surface layer.

Figure 6D:
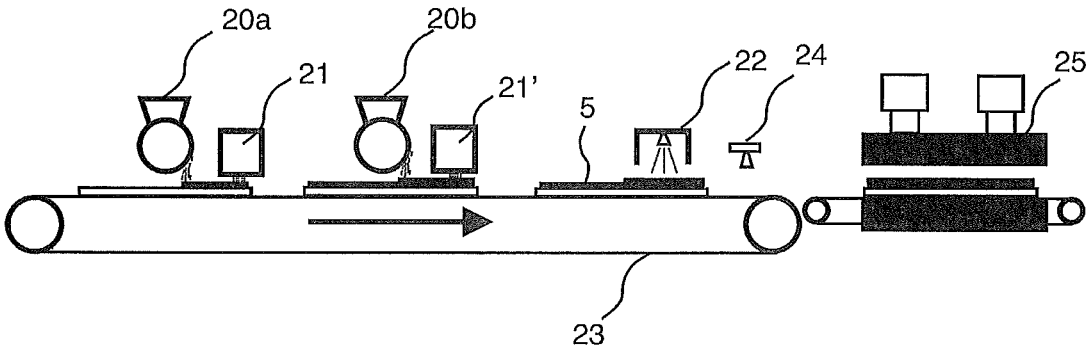
Figure 7A:
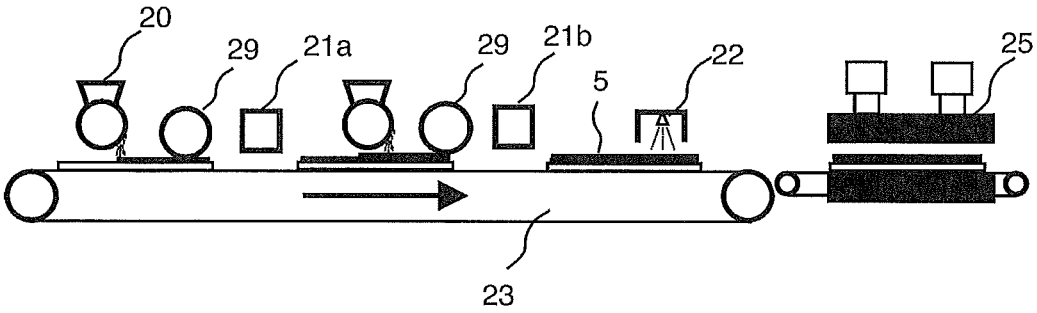
FIGS. 7*a-b* Illustrate alternative methods to form a decorative surface.

FIG. 6*d* shows a similar production line. The difference compared to FIG. 6*a* is that there are two digital ink printing devices or printers 21, 21'. The first digital ink-printing device applies a print on a first layer of a WFF mix in the same way as in FIG. 6*a*. A second scattering unit 20*b* applies a second layer of a WFF mix over the first print and the second digital ink printing device 21' applied a second print over the second WFF layer. A liquid substance is sprayed over the surface by the stabilizing unit 22 and the panel is finally pressed in a press 25. Printing is in this embodiment applied on a scattered surface without pre pressing. It is obvious that the two production methods shown in FIGS. 6*a* and 6*d* can be combined. One or several pre pressing steps can for example be provided prior to the printing as shown in FIG. 7*a* and a third or fourth scattering unit (not shown) can for example apply aluminium oxide and/or binders over the first and/or second print. A liquid colour substance can also be provided prior or after the first and/or the second print.

Figure 7B:
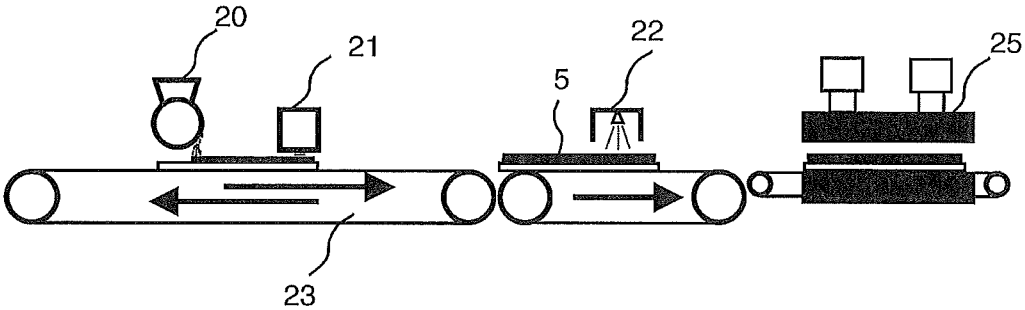

FIG. 7*b* shows that one scattering unit 20 and one digital ink-printing device 21 can be used to apply and print several WFF layers. The conveyor is reversed after the first print and a second WFF layer can be applied and printed. The advantage is that the position of the board can be controlled very accurately and the prints can be positioned precisely over each other. These steps can be repeated and many layers and prints can be applied. Several alternative movements of the panel can be made. The panel can for example be displaced horizontally and perpendicularly to the feeding direction and than moved backwards by a second conveyor to the original starting position.

Figure 8A:
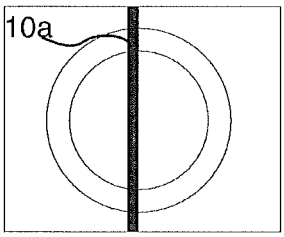
FIGS. 8*a-h* Illustrate methods to test wear resistance and print depth of a printed decorative surface.
Figure 8E:
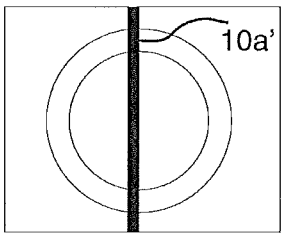
Figure 8B:
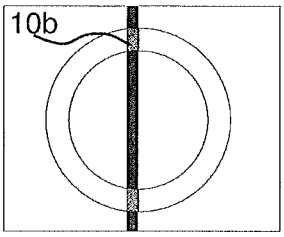
Figure 8F:
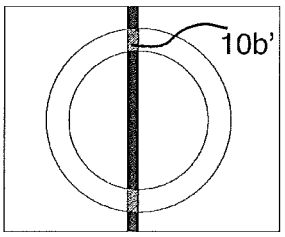
Figure 8C:
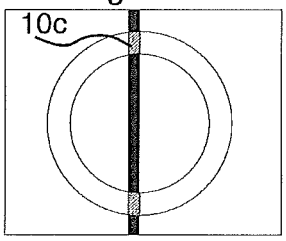
Figure 8G:
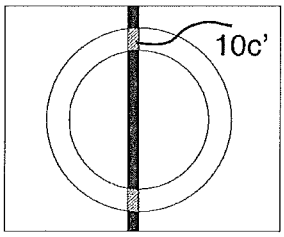
Figure 8D:
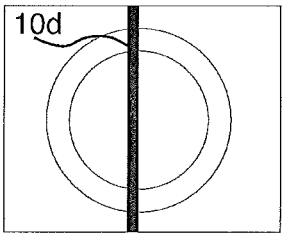
Figure 8H:
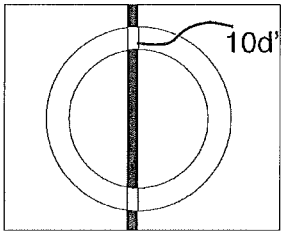

FIGS. 8*a*-8*c* shows how that colour intensity 10*a*-10*c* decreases in a multi printed WFF layer when the surface is subject to wear according to the above-described Taber Abraser testing method. FIG. 8*a* shows the original surface and FIGS. 8*b* and 8*c* show the surface after, for example, 1000-2000 revolutions depending on the print quality. FIG. 8*d* shows that the colour intensity increases again after for example 3000 revolutions due to the fact that the first printed layer becomes visible. FIGS. 8*e*-8*h* shows a single print in a WFF layer. The colour intensity 10*a*'-10*d*' decreases continuously when the surface is subject to wear.

Figure 9:
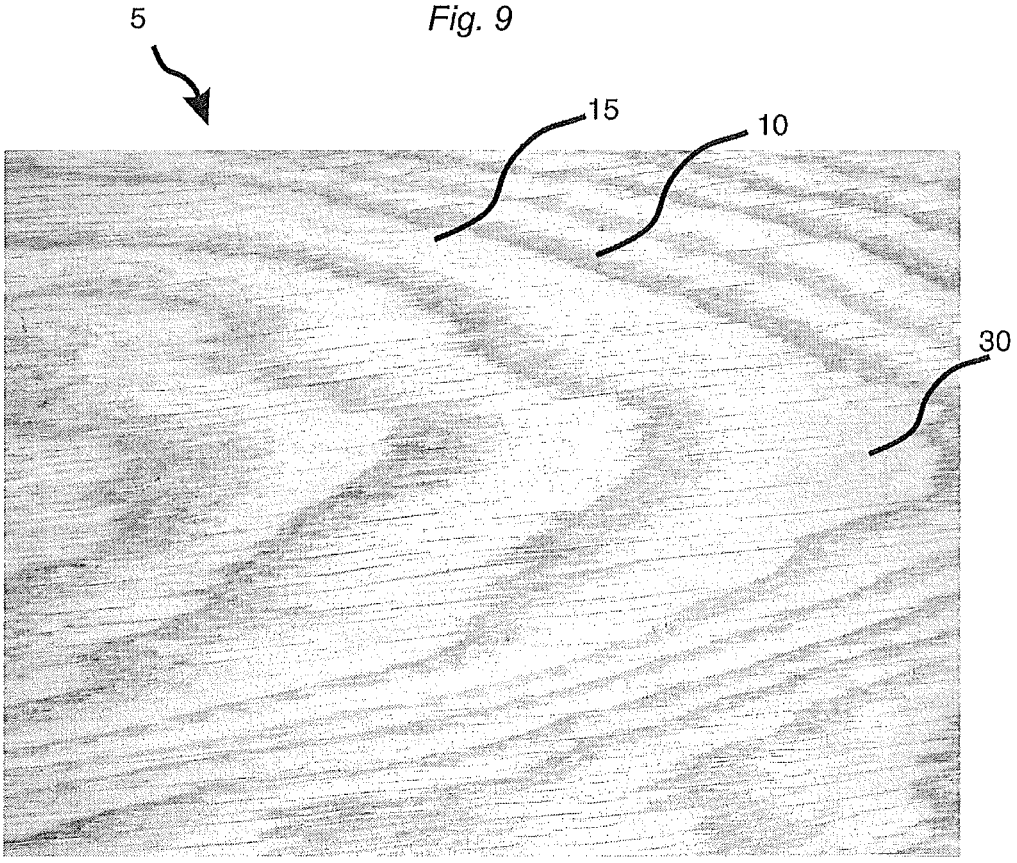
FIG. 9 Illustrate a decorative surface produced by a combination of a base colour, printing and a liquid colour substance.

FIG. 9 shows a surface layer 5 according to an embodiment of the invention with a decorative pattern that is a copy of a wood veneer. The decorative surface comprises a base colour 15, a digital ink print 10 and a liquid colour substance 30.

Figure 10A:
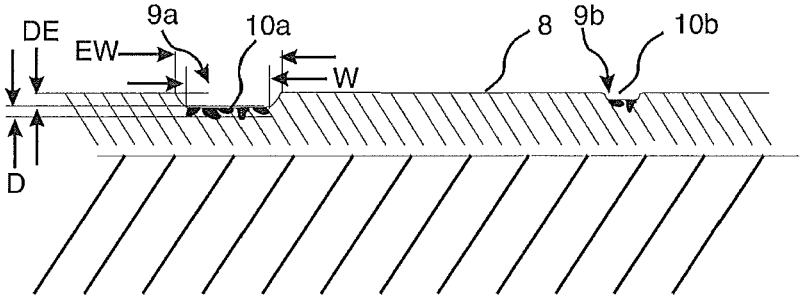
FIGS. 10*a-c* Illustrate a decorative surface with in register embossing and with a printed pattern that varies.
Figure 10B:
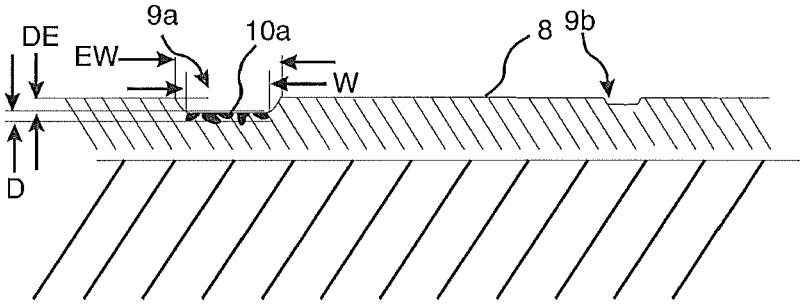
Figure 10C:
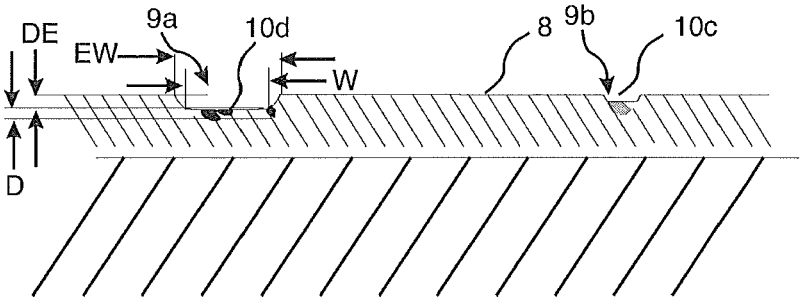
Figure 12A:
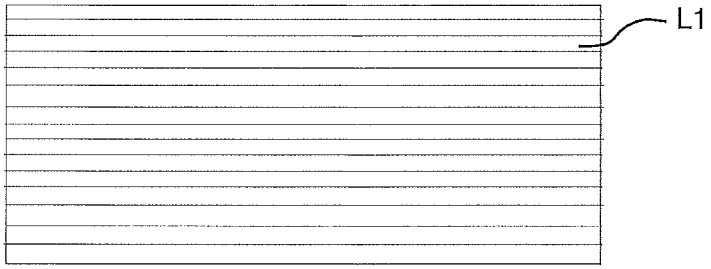
Figure 12B:
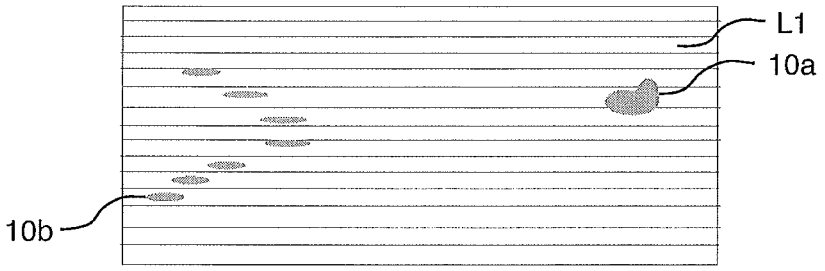
Figure 12C:
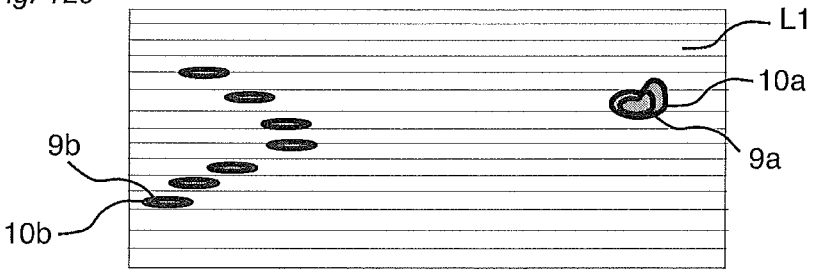
Figure 12D:
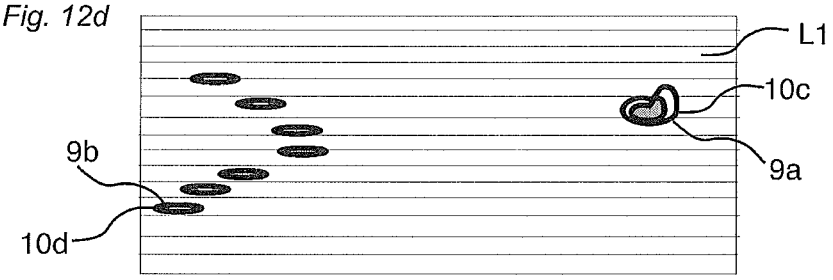
Figure 12E:
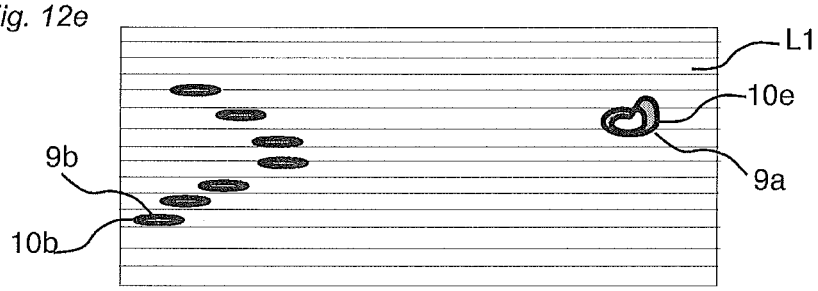

Embossing is preferably made when the powder mix is pressed against an embossed metal plate a matrix. In continuous presses an embossed metal belt or a matrix paper is used. The embossing structure is identical for all pressed boards and this gives a repetition effect. Such problems can be avoided if for example the print 10*a*, 10*b* varies between pressing steps as shown in FIGS. 10*a*-10*c*. FIG. 10 *b* shows an embossed portion 9*b* that has no print. FIG. 10*c* show embossed portions 9*a* and 9*b* that have a different print 10*c*, 10*d* than the print in 10*a* and 10*b* in FIG. 10*a*. The colour or the size of the print varies between the same embossed portions in different panels. Such a "variable in register embossing" will create a visual pattern that looks different in spite of the fact that embossing is identical. This is further shown in FIGS. 12*a*-12*e*. A first powder layer L1 and a first print 10*a*, 10*b* is applied on a board (FIG. 12*b*) and the board is pressed against an embossed press plate such that embossed portions 9*a*, 9*b* are formed in register with the print 10, 10*b* as shown in FIGS. 12*a*-12*c*. FIGS. 12*d* and 12*e* show that the print can be changed between pressing operations. The print 10*c*, 10*d* as shown in FIG. 12*d* can be slightly different than a second print 10*e*, 10*b* in a second pressing as shown in FIG. 12*e*. Colours and shapes can be varied and visible repletion effects can be eliminated.

Figure 14A:
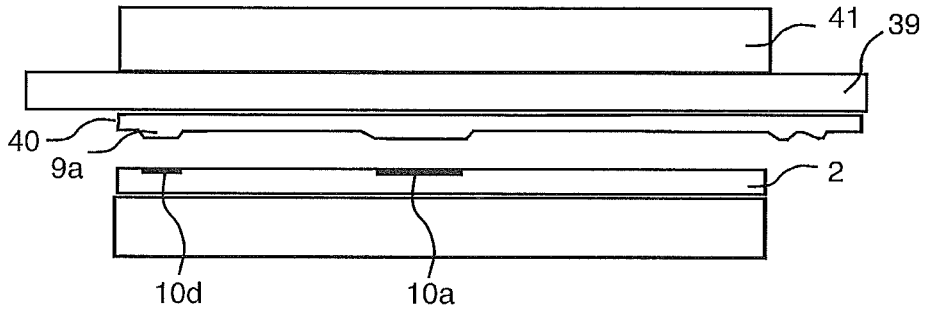
Figure 14B:
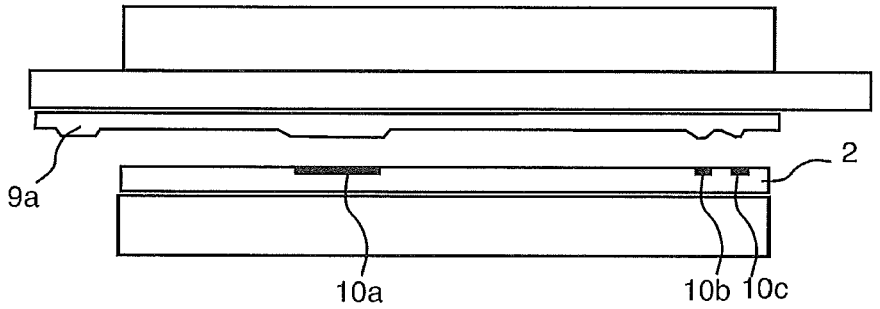
Figure 14C:
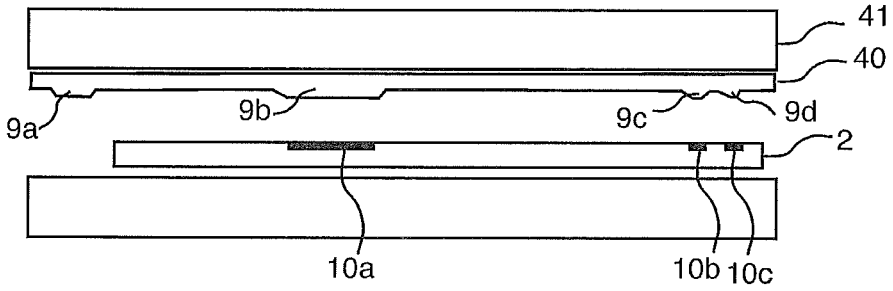
Figure 14D:
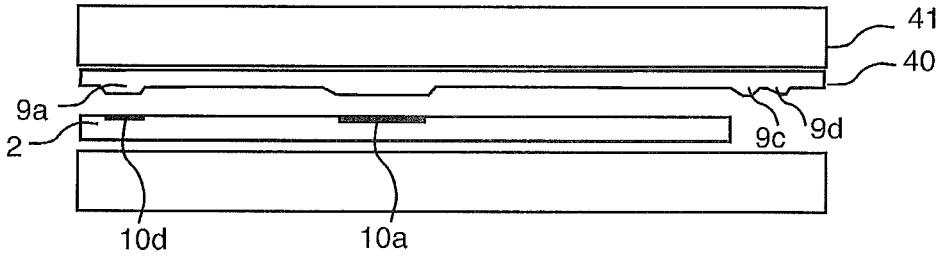

Repetition effects related to embossed structures can be further reduced if for example the press pate 40 is equipped with a sliding device as, shown in FIGS. 14*a*-14*d*, that allows the press plate 40 with its embossed portions 9*a*, 9*b*, 9*c* and 9*d* to be displaced between the pressing steps and the position of the embossed structure on the floor panels can vary. The sliding device can be combined with a heating plate 39 that heats the parts of the press plate that are displaced outside the press table 41. Such a "sliding press plate embossing" requires that the position of the printed patter 10*a*, 10*b* as shown in FIG. 14*a* can also be adjusted. Digital printing allows that a different print 10*a*, 10*b*, 10*c* is applied on the board 2 as shown in FIG. 14*b*. As an alternative an embossed press plate that is larger than the pressed board 2 can be used and the position of the board can vary between different pressing steps as shown in FIGS. 14*c*, 14*d*. This can be made in a simple way with digital printing and the printed pattern 10 can be adjusted such that it always is coordinate with the position of the press plate or the board.

All these principle can be combined and a vide range of individual panels with in register embossing but without visible repetition effects can be obtain. This method can be used in conventional laminate floors. The digital print is in such embodiments applied in the conventional way on the board or on a paper layer.

Figure 11A:
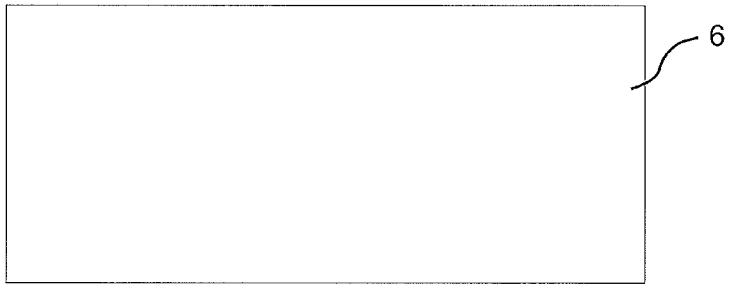
FIGS. 11*a-d* Illustrate a decorative surface comprising two powder layers and a print FIGS. 12*a-e* Illustrate a decorative surface with in register embossing and with a printed pattern that varies.
Figure 11B:
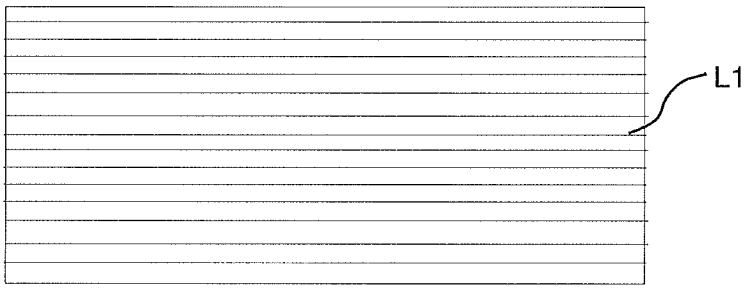
Figure 11C:
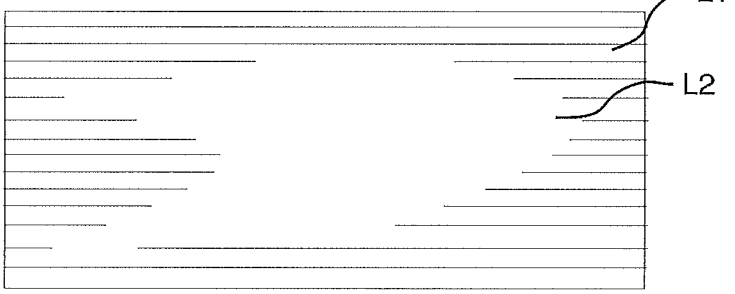
Figure 11D:
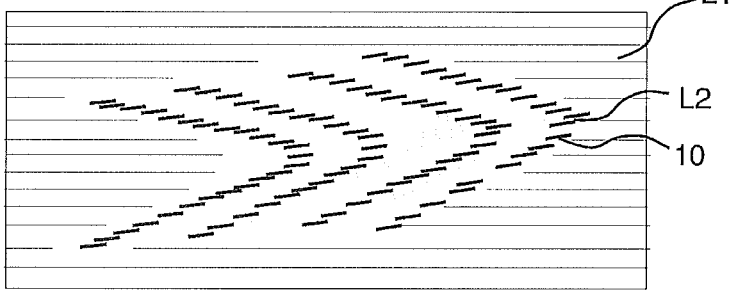

FIGS. 11*a*-11*d* show how several powder layers and a digital print can be combined to provide an advanced and cost effective printed pattern. A first powder layer L1 is applied on a board 6 as shown in FIG. 11*b*. The first powder layer L1 comprises a first base colour. A second powder layer L2 with a second base colour is applied on a part of the surface with by scattering through a template. A digital print is applied on the first and/or second layers. The advantage is that an advanced pattern can be created with limited ink and this can increase the printing speed.

Figure 13A:
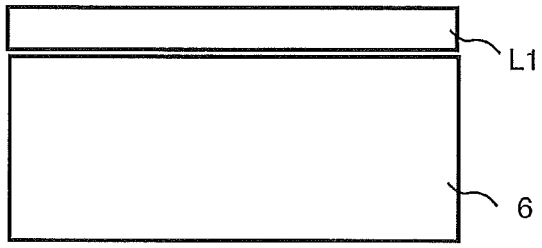
FIGS. 13*a-e* Illustrate a decorative surface and a print with drop size that varies between two layers FIGS. 14*a-d* Illustrate a production method to change the position of embossed portions in a panel surface.
Figure 13B:
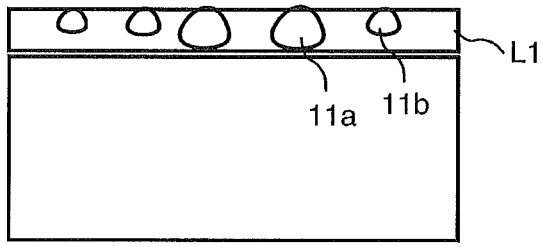
Figure 13C:
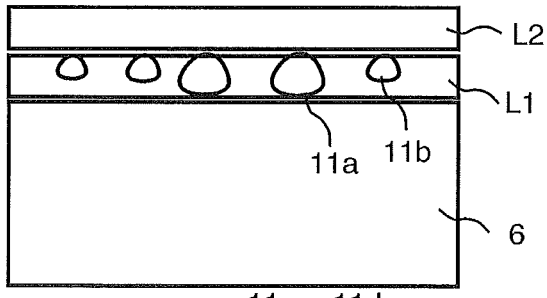
Figure 13D:
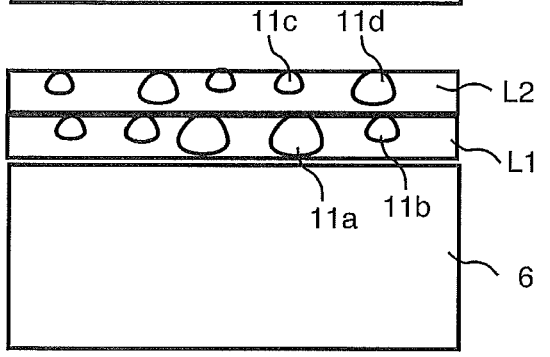
Figure 13E:
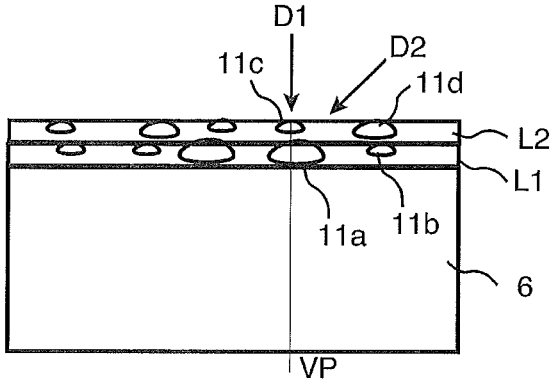

FIGS. 13*a*-13*d* show that different drop sizes can be used, preferably in different semi transparent layers, in order to create an advanced 3D pattern. A first transparent or semi transparent powder layer L1 is applied on a core 6 that can have a virgin colour or that can be coloured in the conventional way of by a powder layer that has been applied on the core and that comprises a base colour. A digital print injects ink drops 11*a*, 11*b* into the first powder layer L1 as shown in FIG. 13*b*. A second transparent or semi transparent powder layer L2 is applied on the first powder layer L1 and a second digital print injects ink drops 11*c*, 11*d* into the second and upper top layer L2. The ink drops in the second layer can be smaller and this gives a high definition print. Drops that are position vertically over each other along a vertical plane VP can create the visible pattern. Such drops can have different size and colour. The design will look different if it is looked upon vertically in the D1 direction or from an angle in the D2 direction as shown in FIG. 13*e* and this will create an advance design that is not possible to obtain when a print is provided by placing drops on a layer side by side.

Figure 15A:
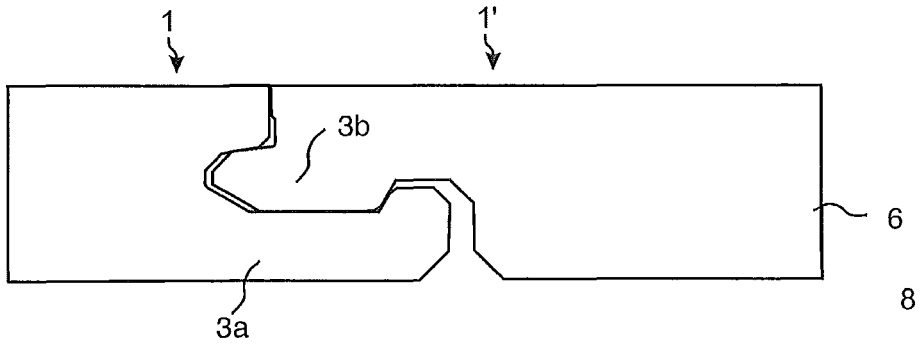
FIGS. 15*a-e* Illustrate a production method to form panels that can create a synchronized large pattern FIGS. 16*a-d* Illustrate examples of the embodiments of the invention.
Figure 15B:
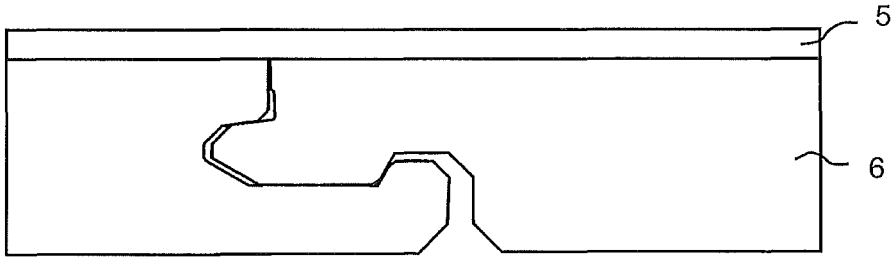
Figure 15C:
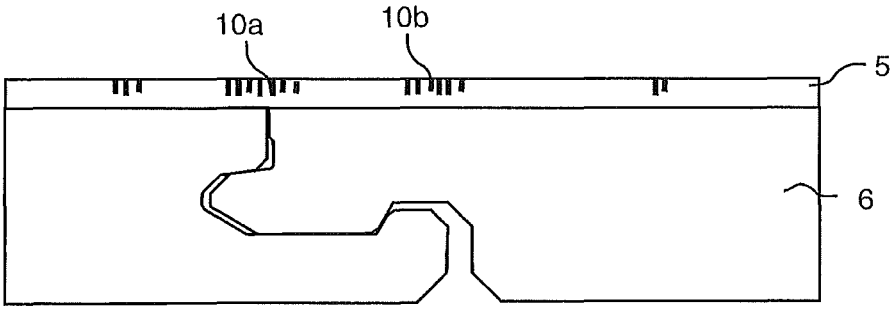
Figure 15D:
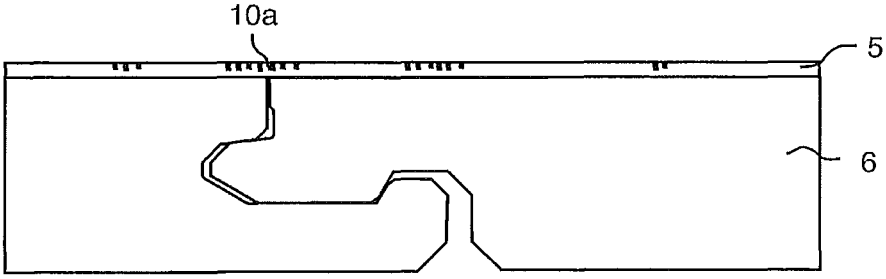
Figure 15E:
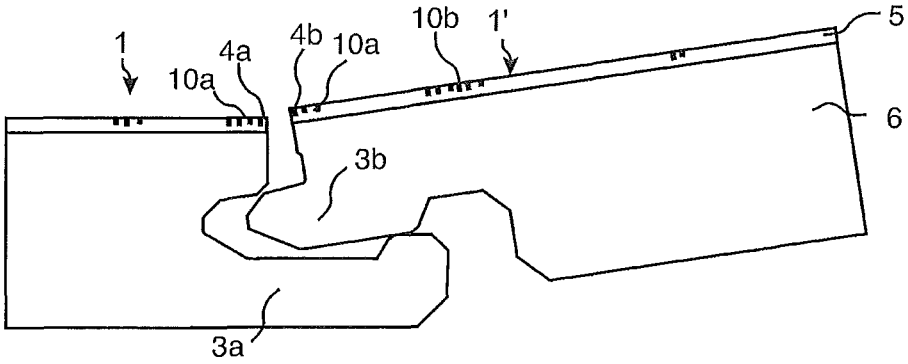
Figure 16A:
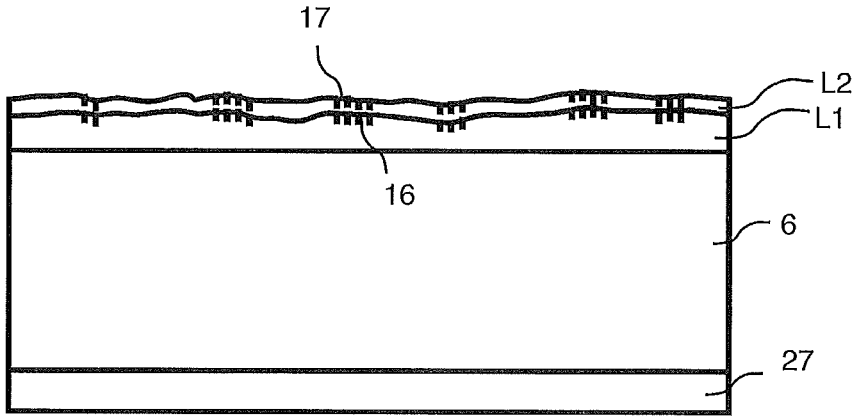
Figure 16B:
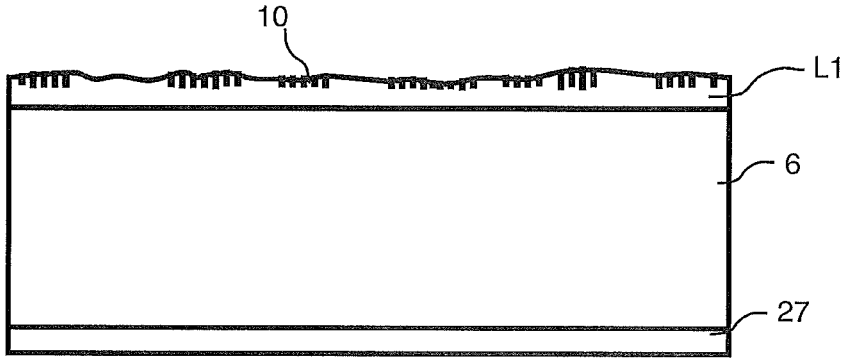
Figure 16C:
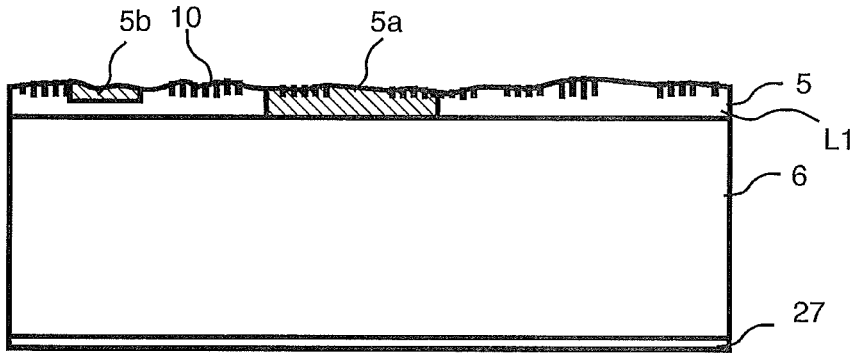
Figure 16D:
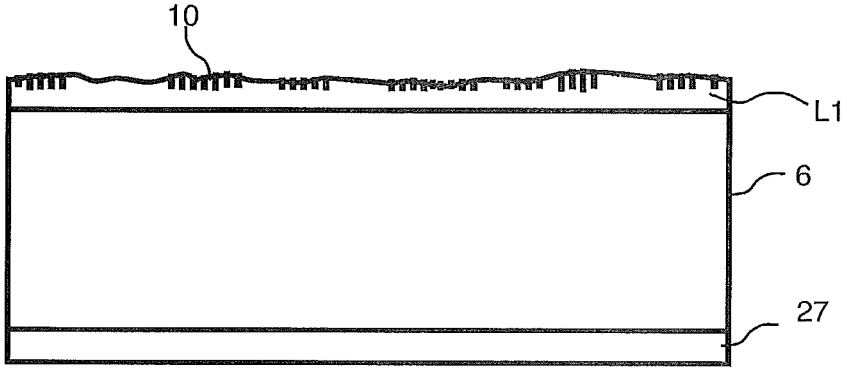
Figure 17A:
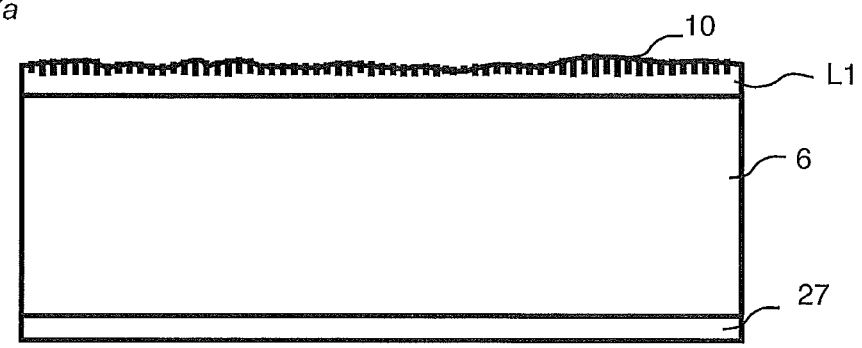
FIGS. 17*a-e* Illustrate examples of the embodiments of the invention.
Figure 17B:
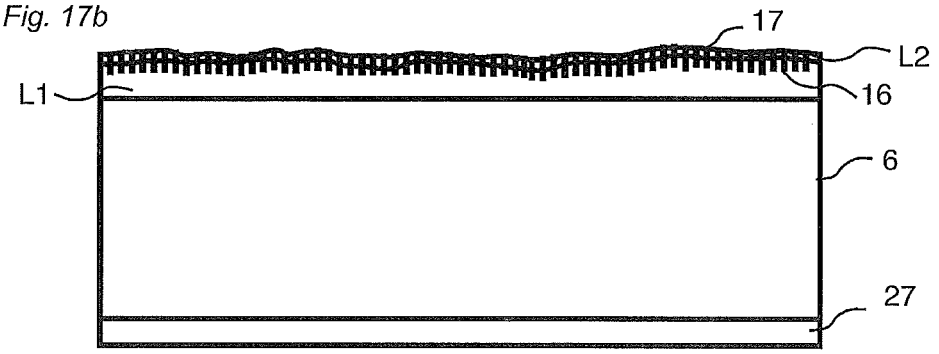
Figure 17C:
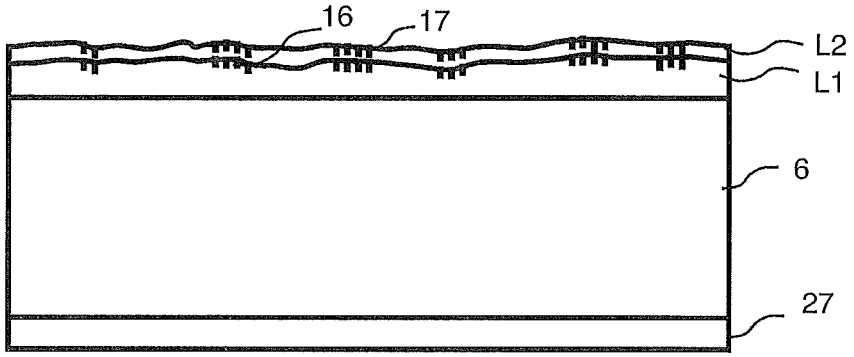
Figure 17D:
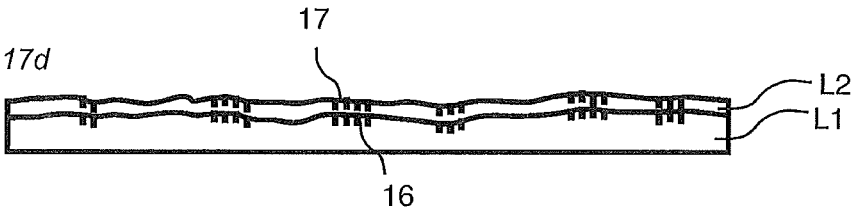
Figure 17E:
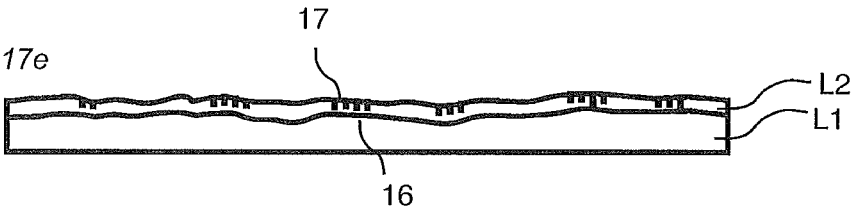

FIGS. 15*a* 15*e* show how a large pattern can be formed that comprises several building panels 1,1'. The problems related to the positioning and forming of a locking system and the adjustment of the design due to material waste of surface material can be eliminated. A locking system 3*a*, 3*b* is machined in a core material 6 for example HDF as shown in FIG. 15*a* and the panels 1, 1' are connected to a large board. A powder mix, preferably a WFF mix, is applied on the connected panels and the mix is printed with a print 10*a*, 10*b* as shown in FIGS. 15*b*, 15*c*. The board comprising several panels is pressed and the surface is cured. The surface will crack along the joint 4*a*, 4*b* when the panels are released from each other as shown in FIG. 15*e*. Surprisingly a powder based surface will crack along a very straight line and the panels can be used and connected without any further machining of the edges 4*a*,4*b*. However, some further machining can be made in order to for example polish the edges or to make small bevels. This limited machining will generally not have any effect on the large pattern, that in spite of the fact that it comprises several panels, will look as one single large pattern or picture that can cover a large area of a floor or a wall.

Where the term "Powder Layer" is used as a term for a pressed board it is meant a layer that was distributed as powder prior to pressing.

EXAMPLES

The terms used in the examples below are defined as follows:

Base color powder layer is a powder layer with a specific color that aims to be fully or partly visual in the final product. The color is typically created by mixing pigment to the powder. A base color powder layer can cover parts of or the full surface.

Semicolored transparent layer is a WFF layer which comprises one part of base color powder and 5-20 parts of semitransparent like the exemplary recipe below. This mixture is used to keep the color at the same color gamut as the base color powder layer.

Semitransparent layer—a WFF layer that is transparent or semitransparent after pressing. This layer is adapted to be suitable to print in. A typical composition of such a layer is: 1 part alpha cellulose, 0.5-1 part aluminium oxide, 1-1.5 part melamine. A layer of for example 100 gram/m2 is quite transparent but a layer of 600 grams/m2 is very "milky".

Example 1

On a HDF board with a thickness of 9.8 mm, two backing papers NKR 140 where fixed on backside for balancing, a WFF powder formulation was added, comprising of 24.5% wood fibre, 17.5% aluminium oxide, 10.5% titanium dioxide as pigment and 47.5% melamine resin.

The WFF powder mix was applied as a first layer by a so-called scattering machine, which distributed the WFF powder material evenly over the HDF surface. The totally amount of WFF powder was 400 g/m$^2$.

A print was applied on the powder by a digital printing device and with a printing quality of 300 DPI.

A second layer with the same composition as the first layer and with an amount of about 100 g/m2 was applied over the first layer and over the print.

A second print was applied on the second layer as a matching pattern located over the first print.

The WFF powder was fixed on the HDF board by spraying a water solution comprising of 97% de-ionize water, 1% BYK-345 (reducing surface tension) and 2% of Pat 622/E (release agent) on the WFF powder.

The above material was placed into a so-called DPL press and pressed at 40 bar in 25 sec with a temperature on the upper daylight at 160° C. and the bottom daylight at 165° C.

A powder based solid surface with a high definition print and with a wear resistance exceeding 6,000 revolutions according to the abrasion class AC5 measured with a Taber Abraser according to ISO-standard was obtained.

Example 2

Example 1 was repeated with the first WFF powder layer pre pressed prior to the first printing and the second WFF layer pre pressed prior to the second printing.

A powder based solid surface with a high definition print and with a wear resistance exceeding 6,000 revolutions according to the abrasion class AC5 measured with a Taber Abraser according to ISO-standard was obtained. The printed pattern in example 2 was more distinct then the pattern in example 1.

All examples below are described from top surface and then down trough the structure.

Example 3

FIG. 16*a*

Print 17 (part or full print, spot or cmyk-print)

Base color powder layer L2 or Semicolored transparent layer, 41-208 g/m2 preferably 125 g/m2.

Print 16 (part or full print, spot or cmyk-print)

Base color powder layer L1 125 g/m2-833 g/m2, preferably 500 g/m2.

Core 6

Backing/balancing layer 27

By adapting the ratio between the powder layers an acceptable wear picture can be achieved until the lower layer of print is worn down.

Example 4

FIG. 16*a*

Print 17 (part or full print, spot or cmyk-print)

Transparent powder layer consisting of thermoplastic particles and wear resistant particles L2 or Semicolored transparent layer consisting of thermoplastic particles, wear resistant particles and pigments, 30-500 g/m2 preferably 100-300 g/m2. Also alpha-cellulose particles can be incorporated into the transparent or Semicolored transparent layer.

Print 16 (part or full print, spot or cmyk-print)

Base color powder layer L1 125 g/m2-833 g/m2, preferably 500 g/m2.

Core 6

Backing/balancing layer 27

By adapting the ration between the powder layers an acceptable wear picture can be achieved until the lower layer of print is worn down.

Example 5

FIG. 16*b*

Spot color ink, part print 10

Base color powder layer 125 g/m2-800 g/m2, preferably 625 g/m2 L2

Core 6

Backing/balancing layer 27

Simple and low cost printer configuration due to only one color to print. Low ink consumption since parts of the visual color is created by the powder.

Example 6

FIG. 16*c*

Spot color ink, part print 10

Base color powder layer 5 or Semicolored transparent layer, partly covering the surface (scattered with or without coordination with the print) 40 g/m2-125 g/m2, preferably 125 g/m2

Base color powder layer 5*a*,5*b* (differs in color compared to the other base color layer) 125 g/m2-800 g/m2, preferably 625 g/m2

Core 6

Backing/balancing layer 27

Comment type 2—Same as type 1 but more advanced design possible since two or several powder colors and one print color are visual in the final in the final product.

Example 7

FIG. 16*d*

CMYK part print 10

Base color powder layer L1, 125 g/m2-800 g/m2, preferably 625 g/m2.

Core 6

Backing/balancing layer 27

Comment type 3—same as type 1 but a standard cmyk configured printer concept can be used.

Example 8

FIG. 17*a*

CMYK full print 10

Semitransparent layer or Semicolored transparent layer L1, 125 g/m2-800 g/m2, preferably 625 g/m2.

Core 6, backing 27

Comment type 4—due to the semitransparent layer a 3 dimensional visual effect can be achieved that enhances the product appearance. Very good wear resistance properties can be reached corresponding to AC3 according to standard EN13329:2006+A1:2008.

Example 9

FIG. 17*b*

CMYK full print 17

Semitransparent or Semicolored transparent layer L2 (for example, 150 gram/m2)

CMYK full print 16

Semitransparent or Semicolored transparent layer L2 (typically thicker than the upper layer—for example 400 gram/m2)

Core 6

Backing/balancing layer 27

Comment type 5—better wear resistance than type 4 due to double print and scattering generating a real 3 dimensional print in the wear layer.

Example 10

FIG. 17*c*

Print 17 (cmyk or spot-color, part or full print)

Semitransparent layer L2, 40 g/m2-300 g/m2, preferably 125 g/m2.

Print 16 (cmyk or spot-color, part or full print)

Base color powder layer L1, 125 g/m2-800 g/m2, preferably 500 g/m2.

Core 6

Backing/balancing layer 27

Comment to example 10—good wear resistance due to double print layer and scattering. The base color of the lower powder layer covers the substrate color and functions as one of the visual colors when the printed layers only is part printed. Very good wear resistance properties can be reached, over AC6 according to standard EN 13329:2006+A1:2008.

The product can be tailor made to meet the requirements of most wear situations by additional powder and print layers.

This embodiment has been produced in three different modes regarding print layer thickness.

Print (cmyk or spot-color, part or full print)

Semitransparent layer, called STL in description below.

Print (cmyk or spot-color, part or full print)

Base color powder layer, called BPL in description below.

Core

Balancing layer/backing

| Type | BPL | STL | Abrasion(REV) | Comment |
|---|---|---|---|---|
| TYPE 9a | 375 g/m2 | 250 g/m2 | >19,000 | A |
| TYPE 9b | 458 g/m2 | 166 g/m2 | 15,000 | B |
| TYPE 9c | 541 g/m2 | 83 g/m2 | 7,000 | C |

Comments:

A. Very durable but a bit of haze appears due to thick semitransparent print layers. The printed pattern is still intact after 19,000 revolutions.

B. Best mode, nice crisp colors in print all through the abrasion process.

C. Nice crisp colors all through abrasion process but not so good in abrasion properties due to very thin semitransparent print layer.

Example 11

FIG. 17*d*

Print 17 (cmyk or spot-color, part or full print)

Transparent or semitransparent layer L2 made of thermoplastic particles and aluminium oxide particles, 40 g/m2-300 g/m2, preferably 125 g/m2.

Print 16 (cmyk or spot-color, part or full print)

Base color powder layer consisting of refined fibres and thermoplastic particles L1, 125 g/m2-5000 g/m2, preferably 200-1000 g/m2 if the produced layer should be glued to another core or 1000-5000 g/m2 if the material it self should be machined with mechanical locking systems for floating installation. For thicker panels even more material can be used.

Example 12

FIG. 17*e*

Print 17 (cmyk or spot-color, part or full print)

Transparent or semitransparent layer L2 made of thermoplastic particles and aluminium oxide particles, 40 g/m2-300 g/m2, preferably 125 g/m2.

Base color powder layer consisting of refined fibres and thermoplastic particles L1, 125 g/m2-5000 g/m2, preferably 200-1000 g/m2 if the produced layer should be glued to another core or 1000-5000 g/m2 if the material it self should be machined with mechanical locking systems for floating installation. For thicker panels even more material can be used.

Example 13

All described samples mentioned so far in this text have been made with a scanning Epson print head shooting 3.5 pl drops at a resolution corresponding to 720×720.

Wear resistant particles can in all examples above be excluded if the intention is to produce a panel for vertical application where a high wear resistance is not needed.

Binders and preferably also fibres in all examples above can be excluded if thermoplastic powder particles are used that melts together when exposed to heat.

The invention claimed is:

1. A method for producing a decorative surface layer, comprising the steps of:

applying a first powder, in powder form, on a substrate to form a first powder layer;

printing a first print with first ink drops on the first powder layer;

spraying a first colored liquid substance on the first powder layer;

applying a second powder, in powder form, on the first powder layer to form a second powder layer after the printing of the first print and the spraying of the first colored liquid substance on the first powder layer;

printing a second print with second ink drops on the second powder layer;

spraying a second colored liquid substance on the second powder layer; and pressing the first and second powder layers to form the decorative surface layer, wherein the printing of the first and second prints is performed by controlling a printed position of each ink drop, and the spraying of the first colored substance is performed by randomly distributing the first colored substance over a first sprayed area and the spraying of the second colored substance is performed by randomly distributing the second colored substance over a second sprayed area, wherein at least some of the second ink drops positioned over at least some of the first ink drops are in direct contact with the at least some of the first ink drops.

2. The method as claimed in claim 1, wherein the ink drops of the first print are positioned in the surface layer at different vertical depths.

3. The method as claimed in claim 2, wherein the average size of the ink drops at an upper vertical position is smaller than the average size of the ink drops at a lower vertical position.

4. The method as claimed in claim 1, wherein the average size of the ink drops in the second powder layer is smaller than the average size of the ink drops in the first layer.

5. The method as claimed in claim 1, wherein the ink drops are of variable size and/or variable colour.

6. The method as claimed in claim 1, wherein the second powder comprises bleached wood fibres and wear resistant particles with a thermosetting binder.

7. The method as claimed in claim 1, wherein the second powder comprises a thermoplastic material and wear resistant particles.

8. The method as claimed in claim 1, wherein the second powder is a semi-transparent powder.

9. The method as claimed in claim 1, wherein the first powder includes fibres and a binder.

10. The method as claimed in claim 9, wherein the fibres are wood fibres.

11. The method as claimed in claim 10, wherein the wood fibres are bleached.

12. The method as claimed in claim 9, wherein the binder is a thermosetting binder.

13. The method as claimed in claim 9, wherein the binder is a thermoplastic binder.

14. The method as claimed in claim 1, wherein the first powder includes a colour substance.

15. The method as claimed in claim 1, wherein the first powder includes wear resistant particles.

16. The method as claimed in claim 1, wherein the second powder includes fibres and a binder.

17. The method as claimed in claim 16, wherein the fibres are wood fibres.

18. The method as claimed in claim 16, wherein the wood fibres are bleached.

19. The method as claimed in claim 16, wherein the binder is a thermosetting binder.

20. The method as claimed in claim 16, wherein the binder is a thermoplastic binder.

21. The method as claimed in claim 1, wherein the second powder includes a colour substance.

22. The method as claimed in claim 1, wherein the second powder includes wear resistant particles.

23. The method as claimed in claim 1, wherein the first powder is a plastic powder.

24. The method as claimed in claim 1, wherein the second powder is a plastic powder.

25. The method as claimed in claim 1, wherein the first printing is made by digital printing.

26. A method for producing a decorative surface layer, comprising the steps of:

applying a first powder, in powder form, on a substrate to form a first powder layer, the first powder comprising first color pigments;

printing a first print with first ink drops on the first powder layer;

spraying a first colored liquid substance on the first powder layer;

applying a second powder, in powder form, on the first powder layer to form a second powder layer after the printing of the first print and the spraying of the first colored liquid substance on the first powder layer, the second powder comprising second color pigments;

printing a second print with second ink drops on the second powder layer;

spraying a second colored liquid substance on the second powder layer; and pressing the first and second powder layers to form the decorative surface layer, wherein the printing of the first and second prints is performed by controlling a printed position of each of the first and second ink drops, and the spraying of the first colored substance is performed by randomly distributing the first colored substance over a first sprayed area and the spraying of the second colored substance is performed by randomly distributing the second colored substance over a second sprayed area, wherein at least some of the second ink drops positioned over at least some of the first ink drops are in direct contact with the at least some of the first ink drops.

27. The method as claimed in claim 1, wherein the second printing is made by digital printing.

28. The method as claimed in claim 1, wherein the first and the second ink drops are of variable size.

29. A method for producing a decorative surface layer, comprising the steps of:

applying a first powder, in powder form, on a substrate to form a first powder layer;

printing a first print with first ink drops on the first powder layer;

applying a second powder, in powder form, on the first powder layer to form a second powder layer;

printing a second print with second ink drops on the second powder layer, the second ink drops being larger than the first ink drops printed on the first powder layer; and applying heat and pressure on the first and second powder layers on the substrate to cure the first and second powder layers into the decorative surface layer which possesses the first print and the second print, wherein at least some of the second ink drops positioned over at least some of the first ink drops are in direct contact with the at least some of the first ink drops.

30. The method as claimed in claim 29, wherein the first ink drops are each less than 5 picoliters in size, and the second ink drops are each between 5-20 picoliters in size.

31. A method for producing a decorative surface layer, comprising the steps of:

applying a first powder, in powder form, on a substrate to form a first powder layer;

printing a first print with first ink drops on the first powder layer, wherein the first ink drops are of variable size;

spraying a first colored liquid substance on the first powder layer;

applying a second powder, in powder form, on the first powder layer to form a second powder layer after the printing of the first print and the spraying of the first colored liquid substance on the first powder layer;

printing a second print with second ink drops on the second powder layer;

spraying a second colored liquid substance on the second powder layer, the second colored liquid substance being a different color than the first colored liquid substance; and pressing the first and second powder layers to form the decorative surface layer, wherein at least some of the second ink drops positioned over at least some of the first ink drops are in direct contact with the at least some of the first ink drops.

32. The method as claimed in claim 25, wherein the second printing is made by digital printing.

33. The method as claimed in claim 26, wherein the first and second color pigments in the first and second powder layers are different colors from one another.

* * * * *